US012187509B2

(12) United States Patent
Drosos et al.

(10) Patent No.: US 12,187,509 B2
(45) **Date of Patent: *Jan. 7, 2025**

(54) CHILD RESISTANT PACKAGING

(71) Applicant: JohnsByrne Company, Niles, IL (US)

(72) Inventors: Michael Drosos, Norridge, IL (US); John Cunningham, Grayslake, IL (US)

(73) Assignee: JohnsByrne Company, Niles, IL (US)

( * ) Notice: Subject to any disclaimer, the term of this patent is extended or adjusted under 35 U.S.C. 154(b) by 276 days.

This patent is subject to a terminal disclaimer.

(21) Appl. No.: 17/672,673

(22) Filed: Feb. 15, 2022

(65) Prior Publication Data

US 2022/0169426 A1 Jun. 2, 2022

Related U.S. Application Data

(63) Continuation-in-part of application No. 16/798,341, filed on Feb. 22, 2020, now Pat. No. 11,535,432, which is a continuation-in-part of application No. 15/915,024, filed on Mar. 7, 2018, now Pat. No. 10,730,671.

(60) Provisional application No. 62/505,253, filed on May 12, 2017, provisional application No. 62/467,897, filed on Mar. 7, 2017.

(51) Int. Cl.
*B65D 50/06* (2006.01)
*B65D 5/38* (2006.01)

(52) U.S. Cl.
CPC ..... *B65D 50/066* (2013.01); *B65D 5/38* (2013.01)

(58) Field of Classification Search
CPC ..... B65D 50/066; B65D 5/38; B65D 2215/02
USPC ..... 206/1.5
See application file for complete search history.

(56) References Cited

U.S. PATENT DOCUMENTS

| | | | |
|---|---|---|---|
| 401,210 | A | 4/1889 | Reed |
| 3,888,350 | A | 6/1975 | Horvath |
| 4,192,422 | A | 3/1980 | Kotyuk |
| 4,365,739 | A | 12/1982 | Webinger |
| 4,428,307 | A | 1/1984 | Vasquez |

(Continued)

FOREIGN PATENT DOCUMENTS

| | | |
|---|---|---|
| GB | 2488451 | 8/2012 |
| JP | 2017007691 | 1/2017 |

(Continued)

OTHER PUBLICATIONS

Origin Pharma Packaging, "SmartX | blister packaging | child resistant tablet carton | tamper evident", Published on May 31, 2017, Relevant Information: 0:53 minute, URL<https://www.youtube.com/watch?v=jNz35iYCk2o>.

(Continued)

*Primary Examiner* — Anthony D Stashick
*Assistant Examiner* — L Kmet
(74) *Attorney, Agent, or Firm* — Allison M. Corder

(57) ABSTRACT

Child resistant packaging for storing medicine or medicinal compositions that frustrates or prevents a child's attempts to access the contents while permitting an adult to easily open the packaging through a series of movements or steps in coordination or combination to readily access the contents. The child resistant packaging includes a housing component and an insert component that is configured to slideably interact with an interior space of the housing component between a locked configuration and an unlocked configuration.

20 Claims, 21 Drawing Sheets

(56) References Cited

U.S. PATENT DOCUMENTS

| | | | |
|---|---|---|---|
| 4,485,915 | A | 12/1984 | Berghahn |
| 4,810,200 | A | 3/1989 | Sakamoto |
| 5,082,137 | A | 1/1992 | Weinstein |
| 5,275,291 | A | 1/1994 | Sledge |
| 5,353,956 | A | 10/1994 | Wilson |
| 5,816,441 | A | 10/1998 | Farside |
| 6,009,069 | A | 12/1999 | Yamashita et al. |
| 6,036,018 | A | 3/2000 | Harrold |
| 6,047,829 | A | 4/2000 | Johnstone et al. |
| 6,230,893 | B1 | 5/2001 | Karow |
| 6,386,209 | B1 | 5/2002 | Yuhara et al. |
| 6,460,693 | B1 | 10/2002 | Harrold |
| 6,641,031 | B2 | 11/2003 | Evans et al. |
| 6,675,972 | B2 | 1/2004 | Patterson |
| 6,874,636 | B2 | 4/2005 | Paliotta et al. |
| 6,988,618 | B2 | 1/2006 | DeJonge |
| 7,090,079 | B2 | 8/2006 | Ehrlund |
| 7,150,355 | B2 | 12/2006 | Coe et al. |
| 7,216,776 | B2 | 5/2007 | Geraldi |
| 7,367,449 | B2 | 5/2008 | Kaminski et al. |
| 7,389,875 | B2 | 6/2008 | Sandberg et al. |
| 7,464,819 | B2 | 12/2008 | Maietta |
| 7,588,149 | B2 | 9/2009 | Geraldi |
| 7,591,372 | B2 | 9/2009 | Geraldi et al. |
| 7,617,935 | B2 | 11/2009 | Reilley et al. |
| 7,658,287 | B2 | 2/2010 | Hession |
| 7,793,784 | B2 | 9/2010 | Nivala |
| 7,802,677 | B2 | 9/2010 | Williams |
| 7,806,270 | B2 | 10/2010 | Seibert et al. |
| 7,845,496 | B2 | 12/2010 | Hession |
| 7,900,772 | B2 | 3/2011 | Sack et al. |
| 7,967,144 | B2 | 6/2011 | Sack et al. |
| 8,011,512 | B2 | 9/2011 | Brollier et al. |
| 8,066,121 | B2 | 11/2011 | Sack et al. |
| 8,333,280 | B2 | 12/2012 | Le |
| 8,365,916 | B2 | 2/2013 | Gelardi |
| 8,490,794 | B2 | 7/2013 | Kalin et al. |
| 8,499,936 | B2 | 8/2013 | Albrecht et al. |
| 8,602,218 | B2 | 12/2013 | Grosskopf |
| 8,672,134 | B2 | 3/2014 | Sprada et al. |
| 8,794,482 | B2 | 8/2014 | Sack et al. |
| 9,174,780 | B2 | 11/2015 | Gelardi et al. |
| 9,180,068 | B2 | 11/2015 | Loftin |
| 9,260,229 | B1 | 2/2016 | Ongchangco |
| 9,326,913 | B2 | 5/2016 | Weston et al. |
| 9,376,246 | B2 | 6/2016 | Jones et al. |
| 9,387,149 | B2 | 7/2016 | Jones et al. |
| 9,452,877 | B2 | 9/2016 | Grosskopf |
| 9,475,605 | B2 | 10/2016 | Everett |
| 10,730,671 | B2 * | 8/2020 | Drosos ..... B65D 50/066 |
| 2004/0045858 | A1 | 3/2004 | Harrold |
| 2004/0099565 | A1 | 5/2004 | Dehlin et al. |
| 2004/0262189 | A1 | 12/2004 | Fraser et al. |
| 2007/0045150 | A1 | 3/2007 | Huffer et al. |
| 2007/0251983 | A1 | 11/2007 | Freeze |
| 2008/0251410 | A1 | 10/2008 | Gelardi |
| 2008/0283434 | A1 | 11/2008 | Gelardi |
| 2009/0045078 | A1 | 2/2009 | Gelardi et al. |
| 2009/0184022 | A1 | 7/2009 | Coe et al. |
| 2009/0266837 | A1 | 10/2009 | Gelardi et al. |
| 2009/0301924 | A1 | 12/2009 | Rondeau |
| 2010/0200581 | A1 | 8/2010 | Maltz |
| 2011/0168712 | A1 | 7/2011 | Bailey et al. |
| 2011/0204074 | A1 | 8/2011 | Gelardi et al. |
| 2011/0226765 | A1 | 9/2011 | Gelardi |
| 2012/0160726 | A1 | 6/2012 | Gelardi |
| 2012/0181204 | A1 | 7/2012 | Bogdziewicz et al. |
| 2012/0199581 | A1 | 8/2012 | Matsuba |
| 2013/0193029 | A1 | 8/2013 | Weston et al. |
| 2014/0251842 | A1 | 9/2014 | Pipes et al. |
| 2014/0262839 | A1 | 9/2014 | Le et al. |
| 2016/0001937 | A1 | 1/2016 | Skinner |
| 2016/0176617 | A1 | 6/2016 | Bolognia et al. |
| 2016/0318651 | A1 | 11/2016 | Jones et al. |
| 2016/0325873 | A1 | 11/2016 | Smith |
| 2016/0347524 | A1 | 12/2016 | Jones et al. |
| 2017/0057688 | A1 | 3/2017 | Patwardhan et al. |
| 2017/0081098 | A1 | 3/2017 | Vercoe et al. |

FOREIGN PATENT DOCUMENTS

| | | |
|---|---|---|
| WO | 1996022229 | 7/1996 |
| WO | 2003010065 | 2/2003 |
| WO | 2006068602 | 6/2006 |

OTHER PUBLICATIONS

McDonald, Candide, "Ecobliss child resistant packaging", Published on May 19, 2014, Relevant Information: 0:12-0:14 minute, URL<https://www.youtube.com/watch?v=8dlNtaq0yul>.

GPSolutionsUKLtd, "Dose Prompt—Visual Patient Reminder System", Published on May 17, 2013, Relevant Information: 0:18-:0:28 minute, URL<https://www.youtube.com/watch?v=q1n1uTENC4M>.

Ecobliss Group, Locked4Kids Certified Child Resistant Cartons, URL<http://www.locked4kids.com> (last visited Apr. 26, 2017).

* cited by examiner

CHILD RESISTANT PACKAGING

CROSS REFERENCE TO RELATED PATENTS

This application is a continuation-in-part of U.S. patent application Ser. No. 16/798,341 filed Feb. 22, 2020, which is a continuation-in-part of U.S. patent application Ser. No. 15/915,024 filed Mar. 7, 2018, now U.S. Pat. No. 10,730,671, which claims the benefit of U.S. Provisional Patent Application No. 62/467,897 filed Mar. 7, 2017 and U.S. Provisional Patent Application No. 62/505,253 filed May 12, 2017, both of which are incorporated by reference.

FIELD OF INVENTION

The invention relates generally to product packaging. More specifically, the invention relates to child resistant packaging for storing medicine or medicinal compositions. The child resistant packaging comprises a two component assembly that frustrates or prevents a child's attempts to access the contents while permitting an adult to easily open the packaging and readily access the contents.

BACKGROUND OF THE INVENTION

Child resistant packaging or CR packaging is special packaging used to reduce the risk of children accessing and ingesting hazardous materials. Current available CR packaging include features to make the opening of packaging more difficult by requiring more strength, for example, thick push-through foils, increased adhesion, greater resistance to tearing at notches, a special safety cap, and squeeze lock levers used with a zipper. Certain of these CR packaging can be problematic for adults or aged individuals.

CR packaging must meet the performance specifications outlined in 16 CFR § 1700.15 and pass testing as outlined in 16 CFR § 1700.20(a)(2)(iii). Currently, child resistant testing is performed with panels of 50 children ranging in age from 42 to 51 months. Children are instructed on how to open the package and that they may use their teeth. Eighty-percent (80%) of the child panel must be unable to open the packaging.

To determine if the CR packaging is senior-friendly, a panel of 100 senior adults ranging in age from 50-70 years are tested to open and close the CR packaging. To pass testing, ninety-percent (90%) of the senior adult panel must open and properly reclose the packaging.

CR packaging openable by applying greater force provides greater safety for children, but can present problems for aged individuals. Therefore, there is a demand for child resistant packaging that can be opened by adults including aged individuals without difficulty. The present invention satisfies this demand by providing an assembly in which an individual must perform a series of movements or steps in coordination or combination to access the package contents.

SUMMARY OF THE INVENTION

The invention is directed to a child resistant packaging for storing product to be kept out of reach by children such as medicine or medicinal compositions. The packaging includes a housing component and an insert component, each with elements that interact to form a locking mechanism. The packaging according to the invention may be certified child resistant and senior-friendly.

Both the housing component and insert component include interacting elements that form a locking mechanism.

The locking mechanism enables a locked configuration and an unlocked configuration between the housing component and the insert component. When the locking mechanism is activated, the insert component cannot be moved with respect to the housing component. When the locking mechanism is deactivated, through a series of movements or steps in coordination or combination, the insert component slideably interacts with the housing component for access to a product stored within the insert component.

The locking mechanism according to the invention includes tab aperture elements, a guide aperture element, and a lip element of the housing component and tab elements and guide recess element of the insert component. In a locked configuration, the tab elements abut the lip element that obstructs movement of the insert component from the housing component. In an unlocked configuration, the tab elements are released from the lip element by way of the tab aperture elements in order to un-obstruct movement of the insert component from the housing component.

The tab aperture elements of the housing component direct a user in placing his or her fingers to apply pressure vertically to the tab elements. The guide aperture element of the housing component directs a user in positioning his or her fingers to apply pressure laterally on the guide recess element to remove a portion of the insert component from the housing component.

In certain embodiments, the packaging may include a lock flap element that forms a receptacle for receiving the tab elements to prevent the insert component from separating from the housing component while the insert component is slideably removed from the housing component.

Further embodiments of the invention may include an insert component that is reversible within the housing component. In a first configuration the locking mechanism is available for use to lock the insert component within the housing component. In the second configuration, the insert component is reversed 180 degrees such that the tab elements are not received by the receptacle. Hence, the locking mechanism is not available for use and the insert component can separate from the housing component while the insert component is removed from the housing component.

The packaging assembly may be constructed from paper, paperboard, or a paper-based material; however, any material is contemplated including polystyrene, plastic, or metal. Certain embodiments may be constructed from a laminated paper-based material. Lamination improves strength and durability of the packaging. For example, laminated material is less susceptible to deterioration from saliva. However, it is noted that cold glue may be used with embodiments that are constructed of non-laminated material.

Each component of the packaging assembly is constructed from sheets comprising a plurality of panels. Although the packaging is detailed and described with respect to a rectangular shaped configuration, any configuration is contemplated, for example square, circular, pentagonal, etc.

Certain embodiments of the invention may include a window element on the housing component and/or insert component. The window element permits viewing of the product or contents without requiring the packaging to be opened.

While the invention is susceptible to various modifications and alternative forms, specific exemplary embodiments are shown by way of example in the following drawings which are described in detail. It should be understood, however, that there is no intent to limit the invention to the particular embodiments disclosed. On the contrary, the intention is to cover all modifications, equivalents, and alternatives falling within the scope of the invention as defined by the appended claims.

BRIEF DESCRIPTION OF THE DRAWINGS

The present invention can be better understood by reading the following detailed description of certain preferred embodiments, reference being made to the accompanying drawings in which.

DETAILED DESCRIPTION OF THE INVENTION

Figure 1:
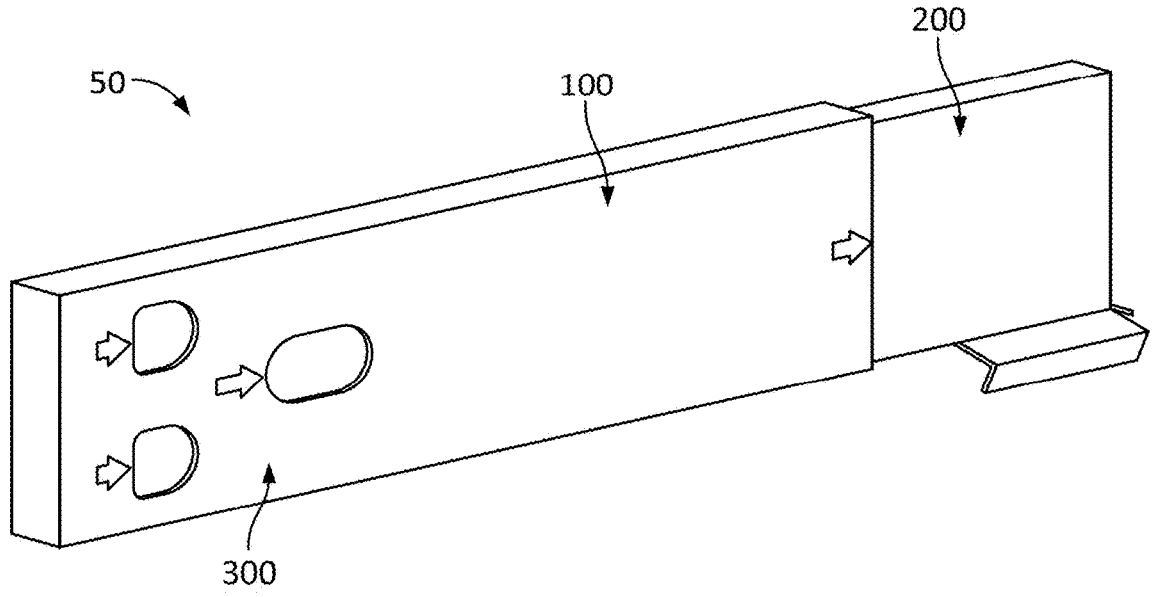
FIG. 1 illustrates a perspective view of the child resistant packaging according to the invention.

A child resistant product packaging is shown in FIG. 1. The packaging 50 includes a housing component 100 and an insert component 200. Both the housing component 100 and insert component 200 include interacting elements that form a locking mechanism 300. The locking mechanism 300 enables a locked configuration and an unlocked configuration between the housing component 100 and the insert component 200. When the locking mechanism 300 is activated, the insert component 200 cannot be moved with respect to the housing component 100. When the locking mechanism 300 is deactivated, through a series of movements or steps in coordination or combination, the insert component 200 slideably interacts with the housing component 100 for access to a product stored within the insert component 200.

Figure 2B:
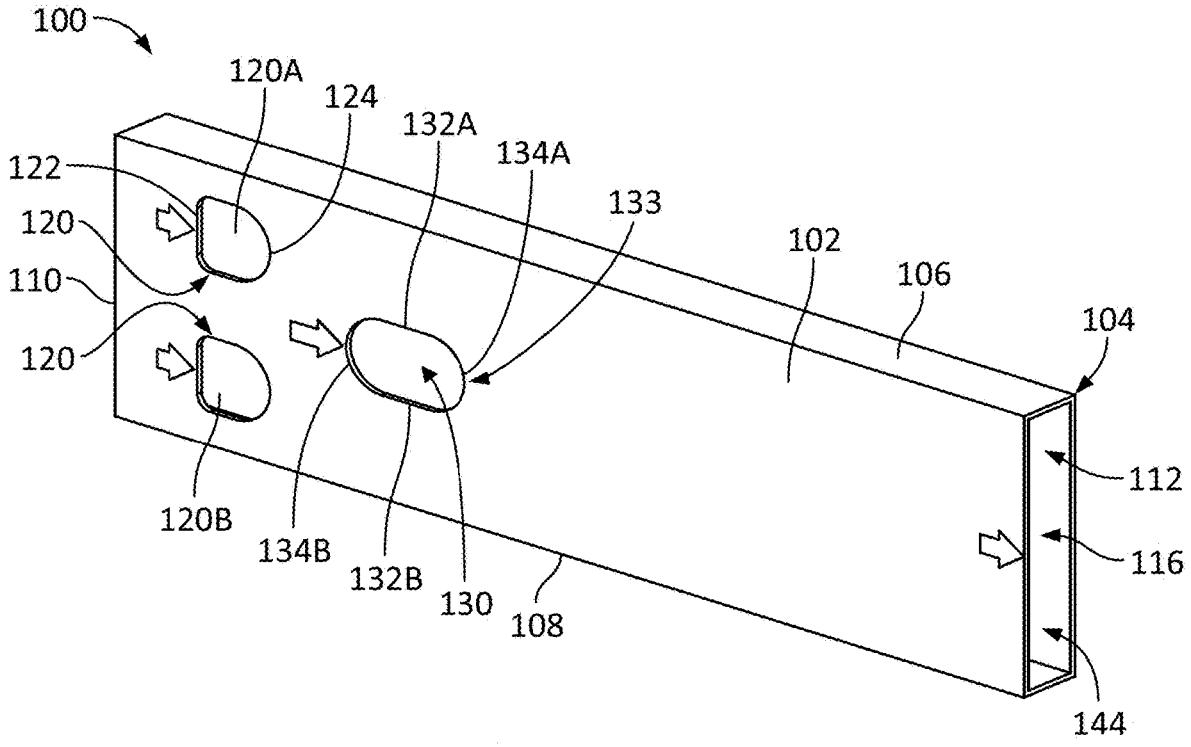
FIG. 2B illustrates a perspective view of a constructed housing component according to the invention.
Figure 2A:
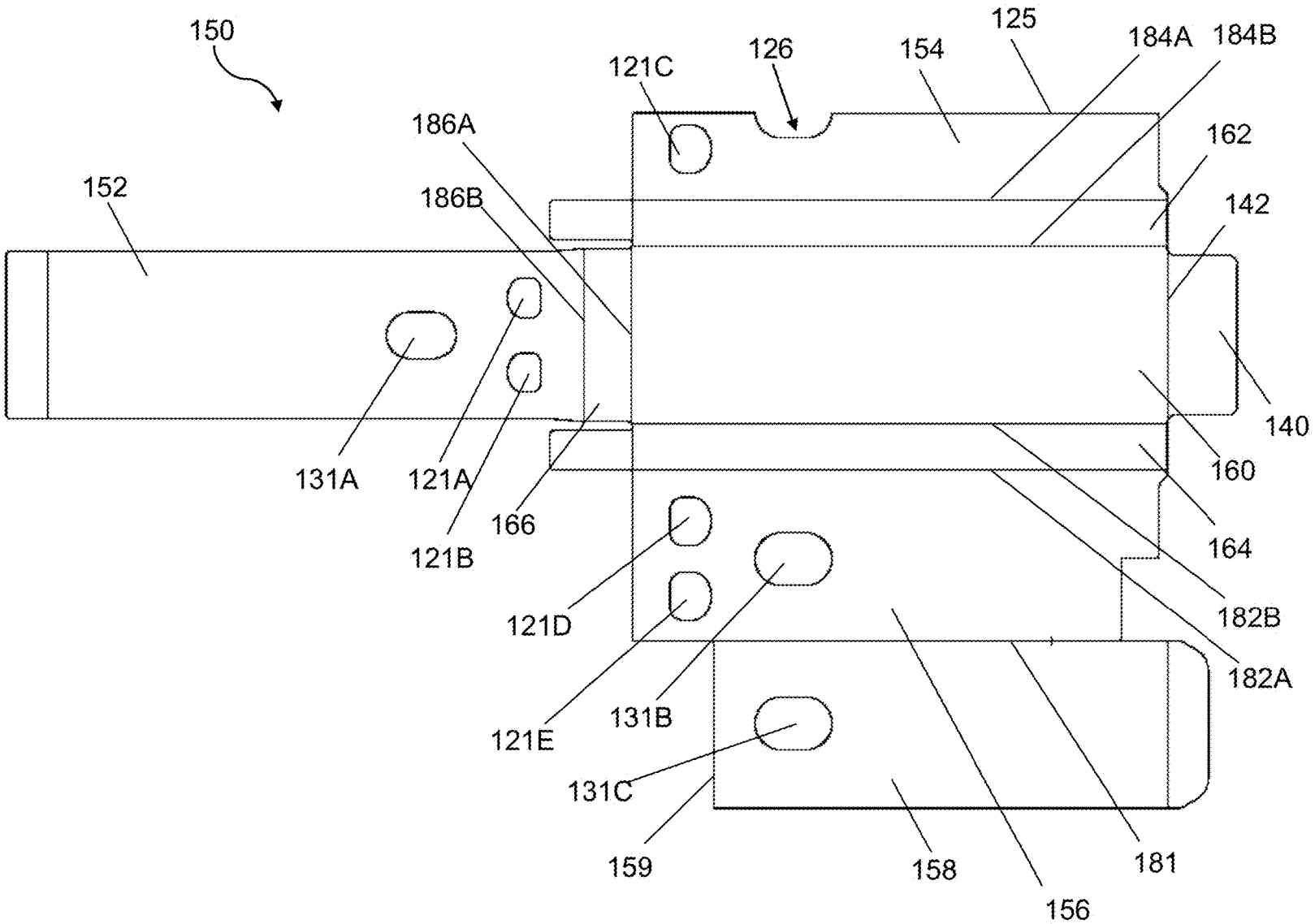
FIG. 2A illustrates a top view of an unconstructed housing component according to the invention.

FIG. 2A illustrates an unconstructed housing component 150. As shown in FIG. 2A, the unconstructed housing component 150 includes a plurality of panels: a first front face panel 152, a second front face panel 154, a third front face panel 156, a fourth front face panel 158, a rear face panel 160, a first side face panel 162, a second side face panel 164, and an end face panel 166.

Figure 5A:
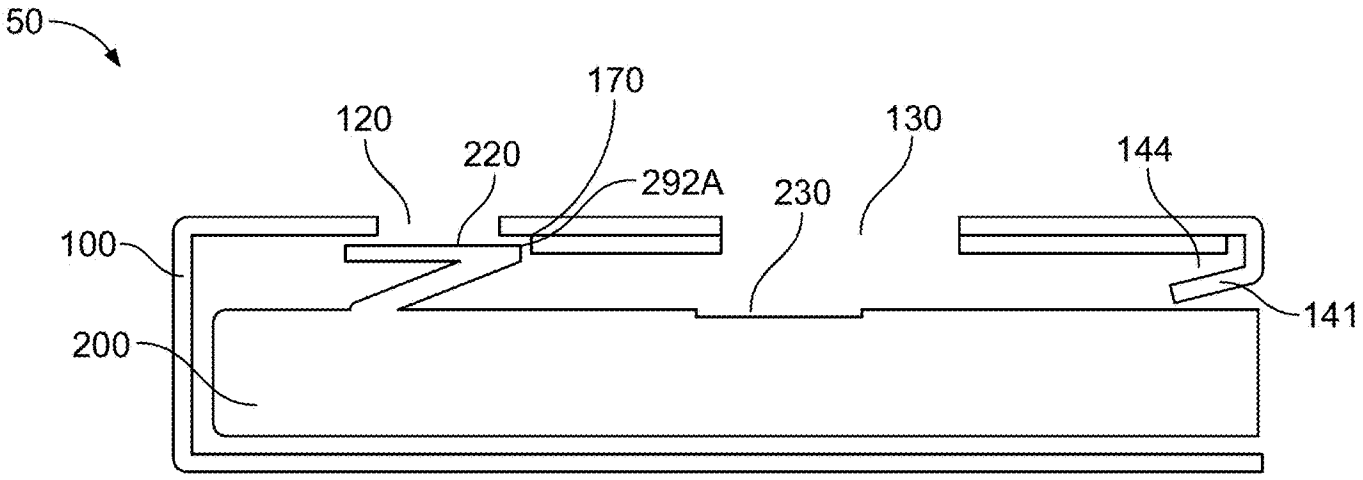
FIG. 5A illustrates a sectional side view of child resistant packaging in a locked configuration according to the invention.

The first front face panel 152 includes first tab openings 121A, 121B and a first guide opening 131A. The second front face panel 154 includes a second tab opening 121C. The second front face panel 154 also includes a removed portion 126 located along perimeter edge 125. The third front face panel 156 includes third tab openings 121D, 121E and a second guide opening 131B. The fourth front face panel 158 includes a third guide opening 131C and a panel edge 159. The rear face panel 160 includes a lock flap panel 140. The lock flap panel 140 is folded along panel border 142 toward the rear face panel 160. The folded lock flap panel 140 forms a receptacle 144 (see FIG. 5A).

The panels of the unconstructed housing component 150 are folded to form the constructed housing component 100 shown in FIG. 2B. As shown in FIG. 2A, fourth front face panel 158 is folded inwardly along fold line 181 to abut third front face panel 156 so that third guide opening 131C and second guide opening 131B are aligned. Second side face panel 164 is folded along fold lines 182A, 182B so that panels 156, 158 are positioned a distance from rear face panel 160. Second front face panel 154 is folded along fold lines 184A, 184B so that second front face panel 154 is positioned atop panels 156, 158. Once folded, second tab opening 121C and third tab opening 121E are aligned. Removed portion 126 is aligned with a portion of guide openings 131B, 131C. Lastly, end face panel 166 is folded inwardly along fold lines 186A, 186B so that first front face panel 152 is positioned over panels 154, 156, 158 such that first guide opening 131A is aligned with removed portion 126, third guide opening 131C, and second guide opening 131B. Panels positioned over or layered on top of other panels provides strength and durability to the packaging. Once constructed with adhesion applied, the panels form an interior space 116 as shown in FIG. 2B.

Turning to FIG. 2B, housing component 100 includes a front face 102, a rear face 104, a first side face 106, a second side face 108, and an end face 110. Housing component 100 includes an open end 112 leading to an interior space 116 for receiving the insert component 200.

Figure 7:
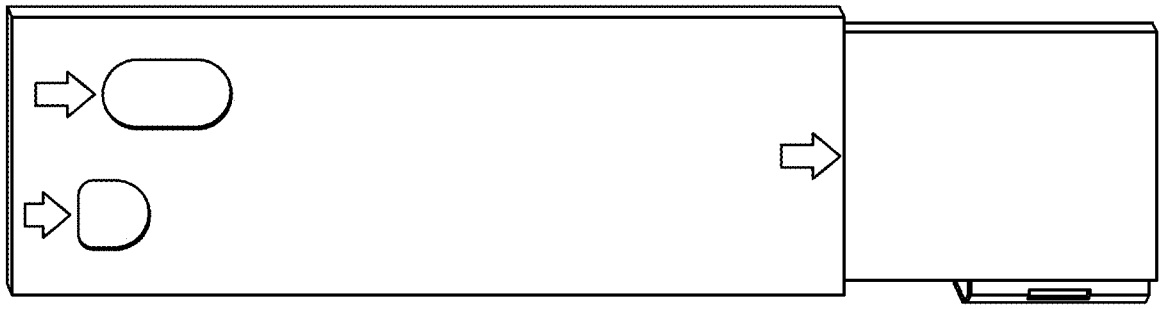
FIG. 7 illustrates a perspective view of the housing component and the insert component in an unlocked configuration according to another embodiment of the invention.

Tab aperture elements 120 are positioned on the front face 102 near the end face 110. Each tab aperture element 120A, 120B is defined by a straight edge border 122 and a curved edge border 124. Although the embodiment shown in FIG. 2B illustrates two tab aperture elements, the packaging may include only one tab aperture element as shown in FIG. 7.

Also located on the front face 102 in proximity to the tab aperture elements 120A, 120B is a guide aperture element 130. Guide aperture element 130 is defined by a continuous connected boundary 133. More specifically, as shown in FIG. 2B, the continuous connected boundary 133 is defined by straight edge boundaries 132A, 132B and curve edge boundaries 134A, 134B. A lock flap element 141 (FIGS. 5A-5D) formed by lock flap panel 140 (FIG. 2A) is located at the open end 112 by the folding of lock flap panel 140 along panel border 142 (FIG. 2A). As shown in FIGS. 5A-5D, the lock flap element 141 forms a receptacle 144. Within the interior space 116, a lip element 170 is located between the tab aperture elements 120 and guide aperture element 130. Lip element 170 is formed by panel edge 159 (FIG. 2A).

Figure 3A:
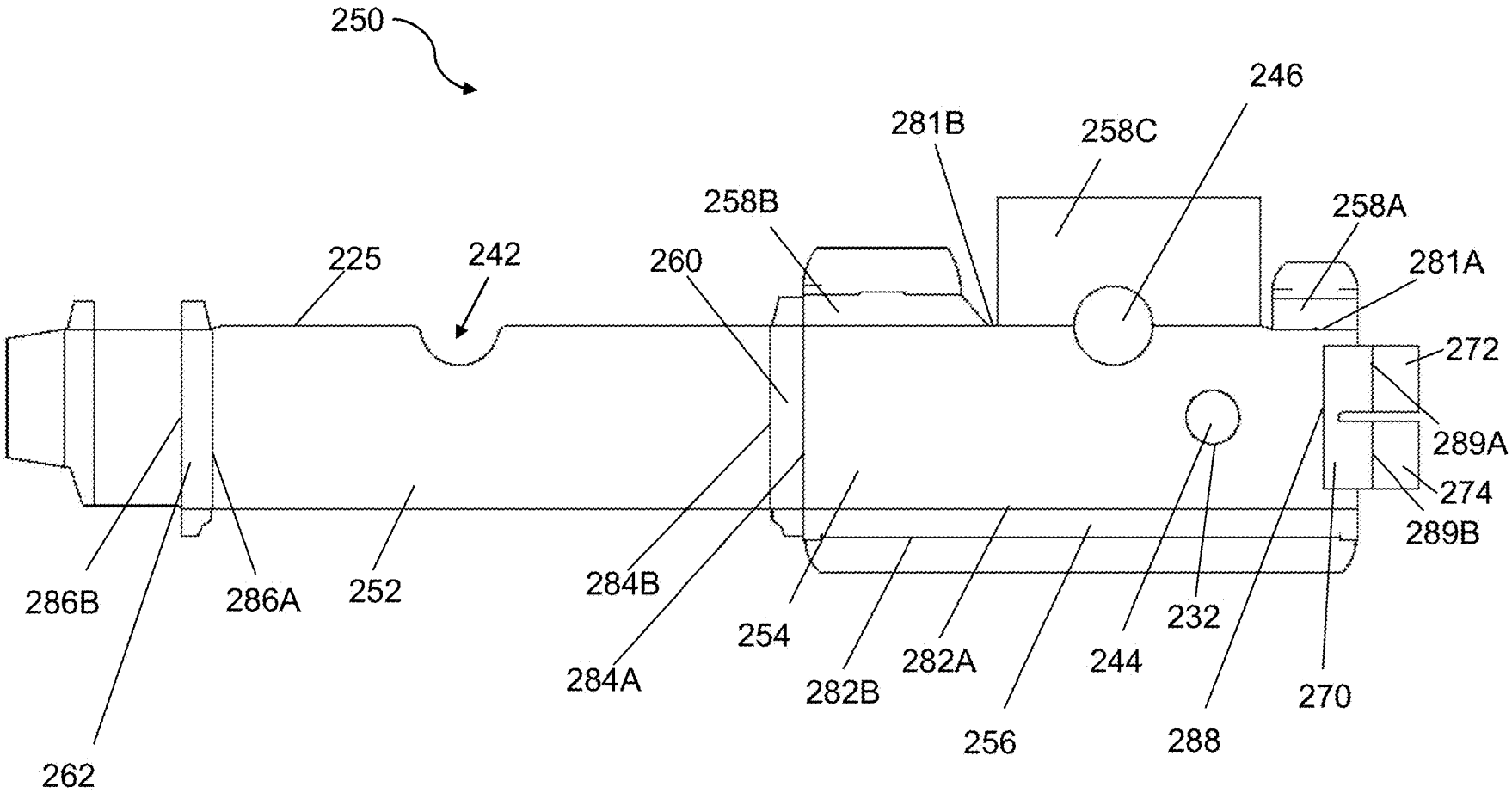
FIG. 3A illustrates a top view of an unconstructed insert component according to the invention.

FIG. 3A illustrates an unconstructed insert component 250. As shown in FIG. 3A, the unconstructed insert component 250 includes a plurality of insert panels: a top surface panel 252, a bottom surface face panel 254, a first side surface panel 256, three second side surface panels 258A, 258B, 258C, an end surface panel 260, a front surface panel 262, and a tab panel 270.

The top surface panel 252 includes removed portion 242 along perimeter edge 225. The bottom surface face panel 254 includes a guide opening 244. The guide opening 244 is defined by an edge border 232. Although the guide opening 244 is shown as a circle in FIG. 3A, any shape is contemplated. Opening 246 is positioned so that portions of opening 246 reside on bottom surface face panel 254 and side surface panel 258C. Tab panel 270 includes a first tab portion 272 and a second tab portion 274. Although the embodiment as shown illustrates the first tab portion 272 independent from the second tab portion 274, it is contemplated that the first tab portion 272 and the second tab portion 274 may be one in the same.

Figure 3B:
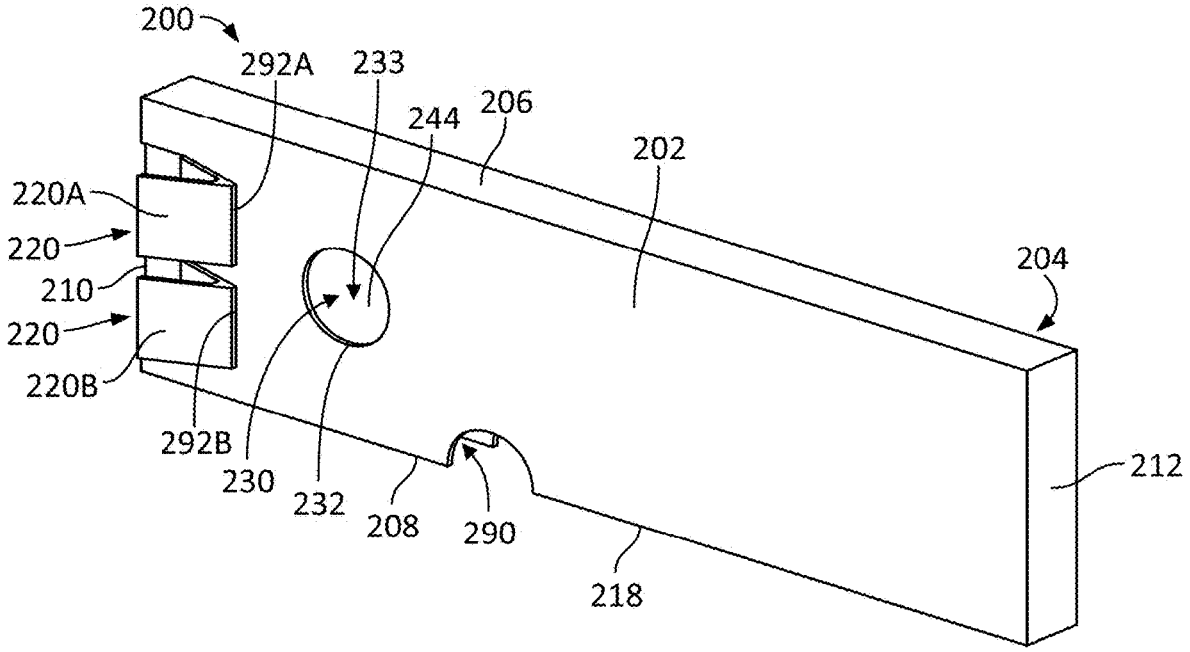
FIG. 3B illustrates a perspective view of a constructed insert component according to the invention.

The panels of the unconstructed insert component 250 are folded to form the constructed insert component 200 shown in FIG. 3B. As shown in FIG. 3A, second side surface panel 258C is folded inwardly along fold line 281B so that opening 246 forms a feature similar, if not identical, to removed portion 242. Once folded, second side surface panel 258C abuts and covers guide opening 244. Side surface panels 258A and 258B are folded along fold lines 281A and 281B, respectively. First side surface panel 256 is folded inwardly along fold lines 282A, 282B. End surface panel 260 is folded along fold lines 284A, 284B so that top surface panel 252 is positioned a distance from bottom surface panel 254. Then, front surface panel 262 is folded along fold lines 286A, 286B. Tab panel 270 is folded inwardly to bottom surface panel 254 along fold line 288. Furthermore, first tab portion 272 and second tab portion 274 are folded outward from bottom surface panel 254 along fold lines 289A, 289B, respectively. In this embodiment of the invention, fold line 288 is parallel to 289A, 289B. Once constructed with adhesion applied, the panels form a cavity 218 as shown in FIG. 3B for storing product.

As shown in FIG. 3B, insert component 200 includes a top surface 202, a bottom surface 204, a first side surface 206, a second side surface 208, an end surface 210, and a front surface 212. Insert component 200 includes a cavity 218 for receiving a product.

As shown in FIG. 3B, tab elements 220 are positioned on the top surface 202 near end surface 210 and are constructed from a tab panel 270 and a tab portion 272 (FIG. 3A). Once constructed, tab elements 220 include folds 292. Each fold 292A, 292B formed at fold lines 289A, 289B (FIG. 3A) are oriented parallel to end surface 210 and front surface 212, or perpendicular to first side surface 206 and second side surface 208. Each tab element 220A, 220B is a folded protrusion providing resiliency, i.e., tab elements 220 possesses a spring-like action. As shown, tab elements 220 are illustrated as a rectangular protrusion, however any shaped protrusion is contemplated. Also located on the top surface 202 in proximity to the tab elements 220 is a guide recess element 230. The guide recess element 230 is defined by opening 244 including edge border 232 and a base element 233. The base element 233 is formed from a portion of the second side surface panel 258C (FIG. 3A) that is exposed through the opening 244. Although the guide recess element 230, particularly the edge border 232, is shown as circular shaped, any shape is contemplated. Insert component 200 also includes indicator elements 290 located on each of the top surface 202 and the bottom surface 204. The indicator elements 290 are semi-circular shaped and assist with removing the product from the cavity 218.

Figure 4:
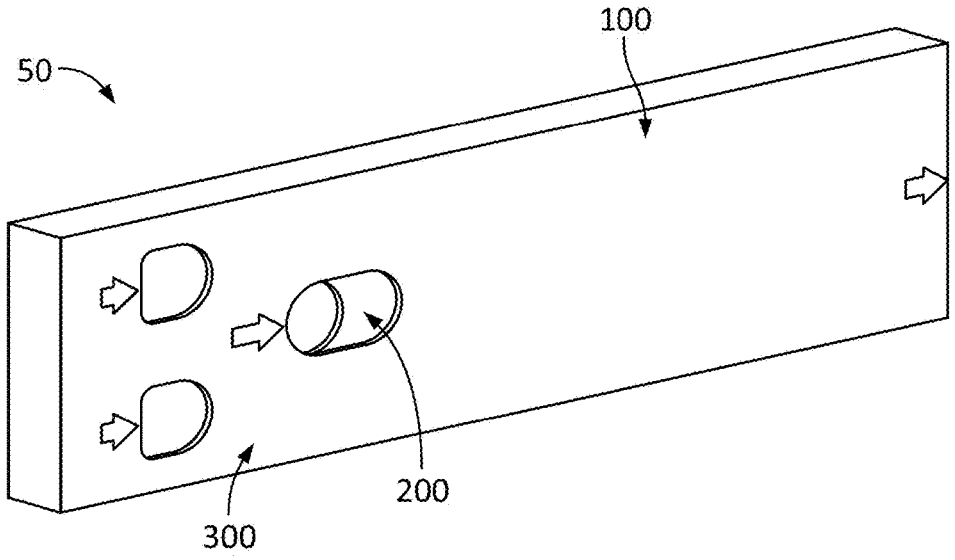
FIG. 4 illustrates a perspective view of the housing component and the insert component in a locked configuration according to the invention.
Figure 5B:
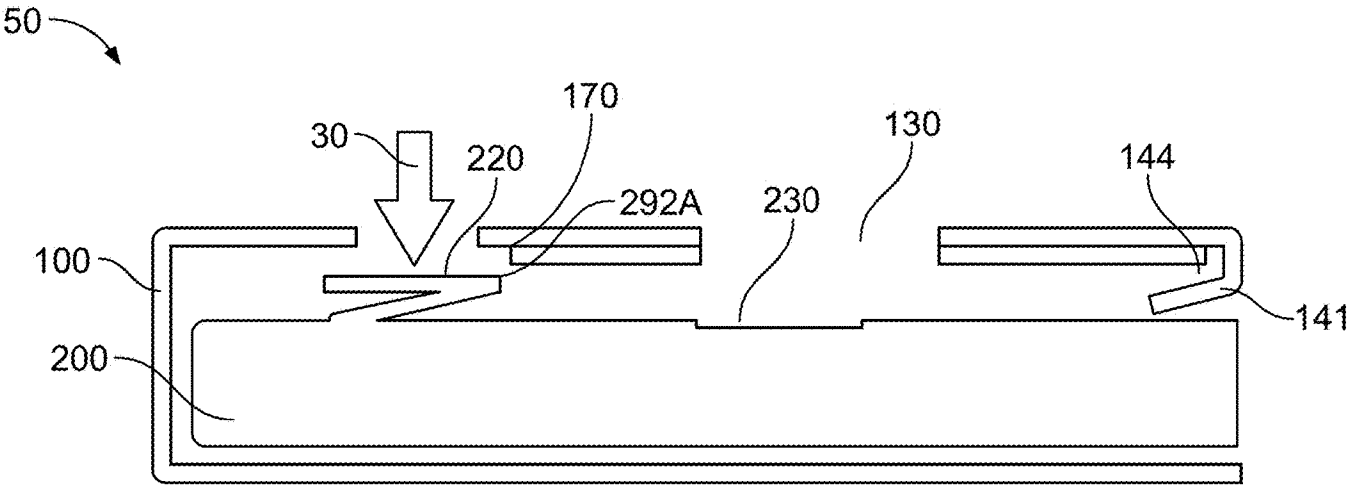
FIG. 5B illustrates a sectional side view of child resistant packaging in an unlocked configuration according to the invention.
Figure 5C:
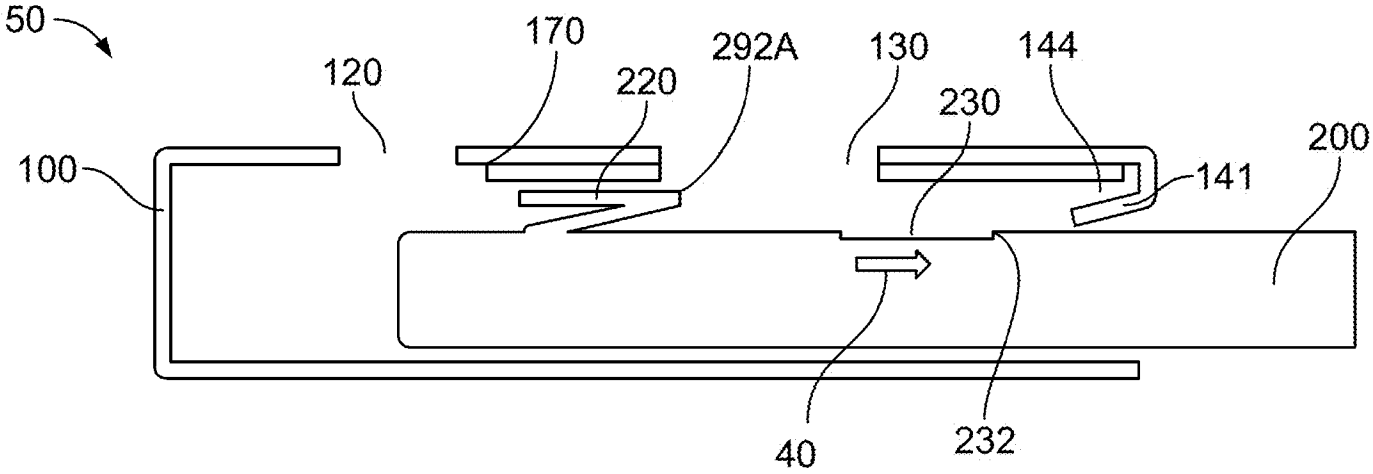
FIG. 5C illustrates a sectional side view of the child resistant packaging in an unlocked configuration according to the invention.

FIG. 4 illustrates a perspective view of the packaging 50 including housing component 100 and an insert component 200 with the locking mechanism 300 in a locked configuration according to the invention. As seen in the sectional side view of FIG. 5A, the tab elements 220 abut the lip element 170 obstructing movement of the insert component 200 from the interior space 116 (FIG. 2B) of the housing component 100. More specifically, folds 292A, 292B formed at fold lines 289A, 289B of tab portions 272, 274 (FIG. 3A), respectively, abut panel edge 159 (FIG. 2A). As shown in FIG. 5B, vertical pressure 30 is applied to the tab elements 220—e.g., pressure is applied simultaneously to tab panel 270 and tab portion 272 and/or tab panel 270 and tab portion 274—such that the tab elements 220 are released, specifically folds 292A, 292B are free from the lip element 170 by way of the tab aperture elements 120 in order to un-obstruct movement of the insert component 200 from the housing component 100. To remove a portion of the insert component 200 from the housing component 100, lateral pressure 40 is applied to the edge border 232 of the guide recess element 230 as shown in FIG. 5C. With a portion of the insert component 200 removed from the housing component 100, a user may grasp this portion—such as by top surface 202 and bottom surface 204—near the front surface 212 to further remove the insert component 200 from the housing component 100.

Figure 5D:
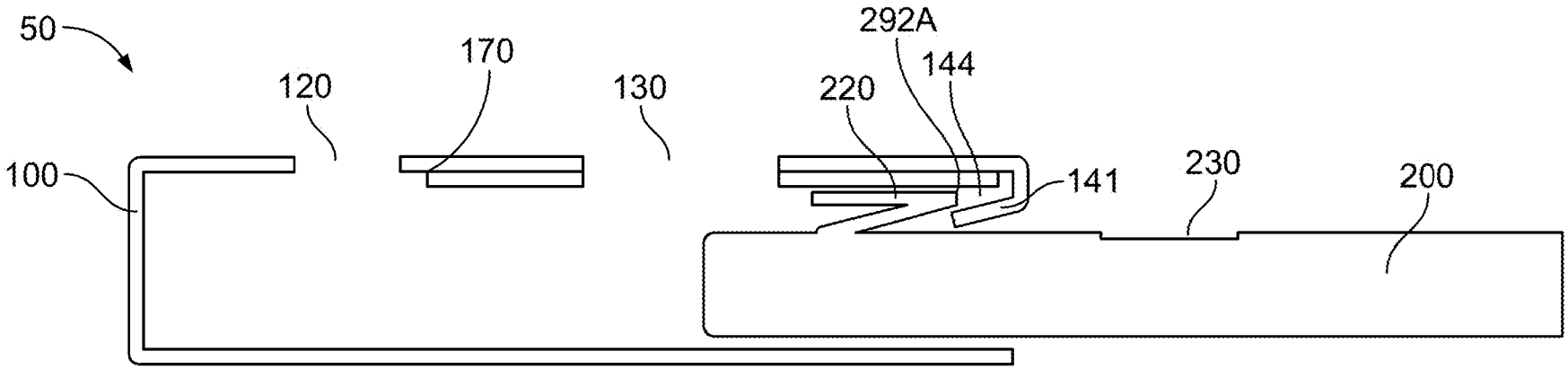
FIG. 5D illustrates a sectional side view of the child resistant packaging in an unlocked configuration according to the invention.
Figure 6:
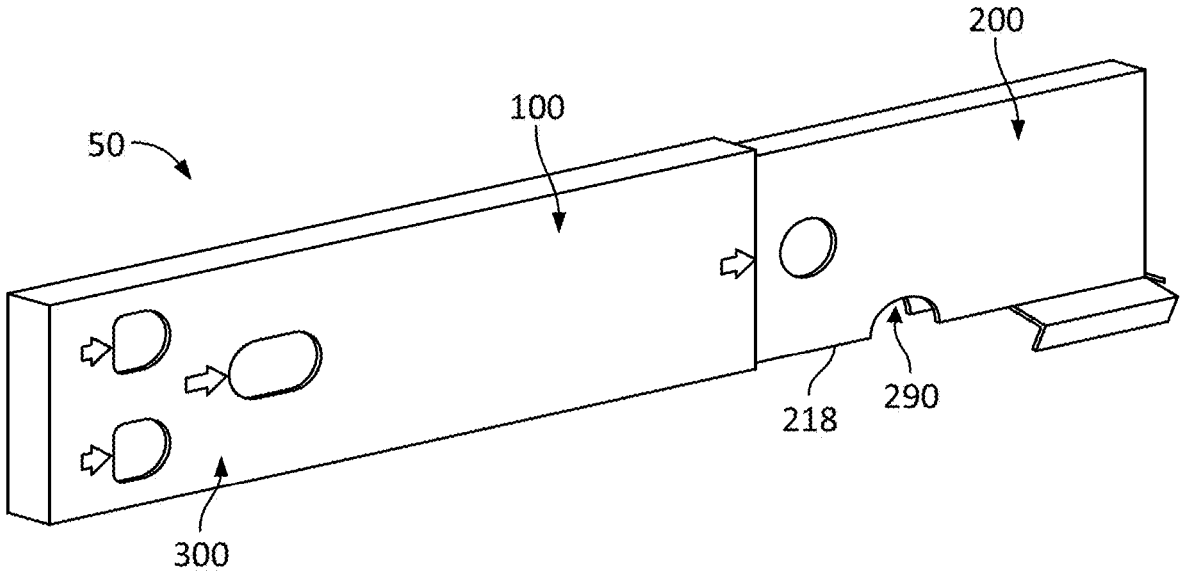
FIG. 6 illustrates a perspective view of the housing component assembled with the insert component in an unlocked configuration according to the invention.

As shown in FIG. 5D, lock flap element 141 forms a receptacle 144 for receiving the tab elements 220. The receptacle 144 receives tab elements 220 to prevent the insert component 200 from separating from the housing component 100 while the insert component 200 is removed from the housing component 100. FIG. 6 illustrates a perspective view of the packaging 50 in an unlocked configuration according to the invention. Indicator elements 290 located on the insert component 200 assist with removing product from the cavity 218.

Figure 8:
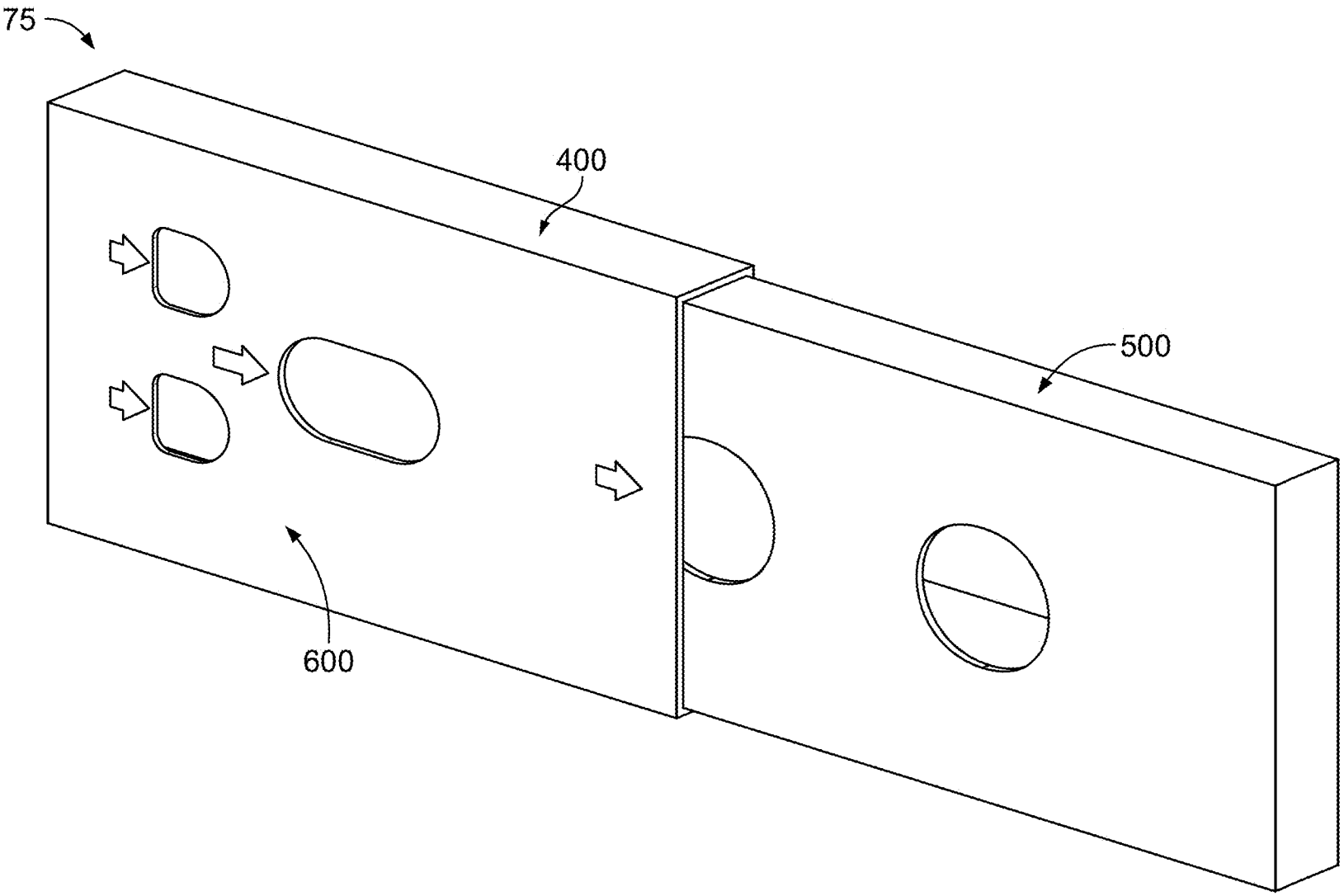
FIG. 8 illustrates a perspective view of the child resistant packaging according to another embodiment of the invention.

A child resistant product packaging according to another embodiment is shown in FIG. 8. The packaging 75 includes a housing component 400 and an insert component 500. Both the housing component 400 and insert component 500 include interacting elements that form a locking mechanism 600. The locking mechanism 600 enables a locked configuration and an unlocked configuration between the housing component 400 and the insert component 500. When the locking mechanism 600 is activated, the insert component 500 cannot be moved with respect to the housing component 400. When the locking mechanism 600 is deactivated, through a series of movements or steps in coordination or combination, the insert component 500 slideably interacts with the housing component 400 for access to a product stored within the insert component 500.

Figure 9A:
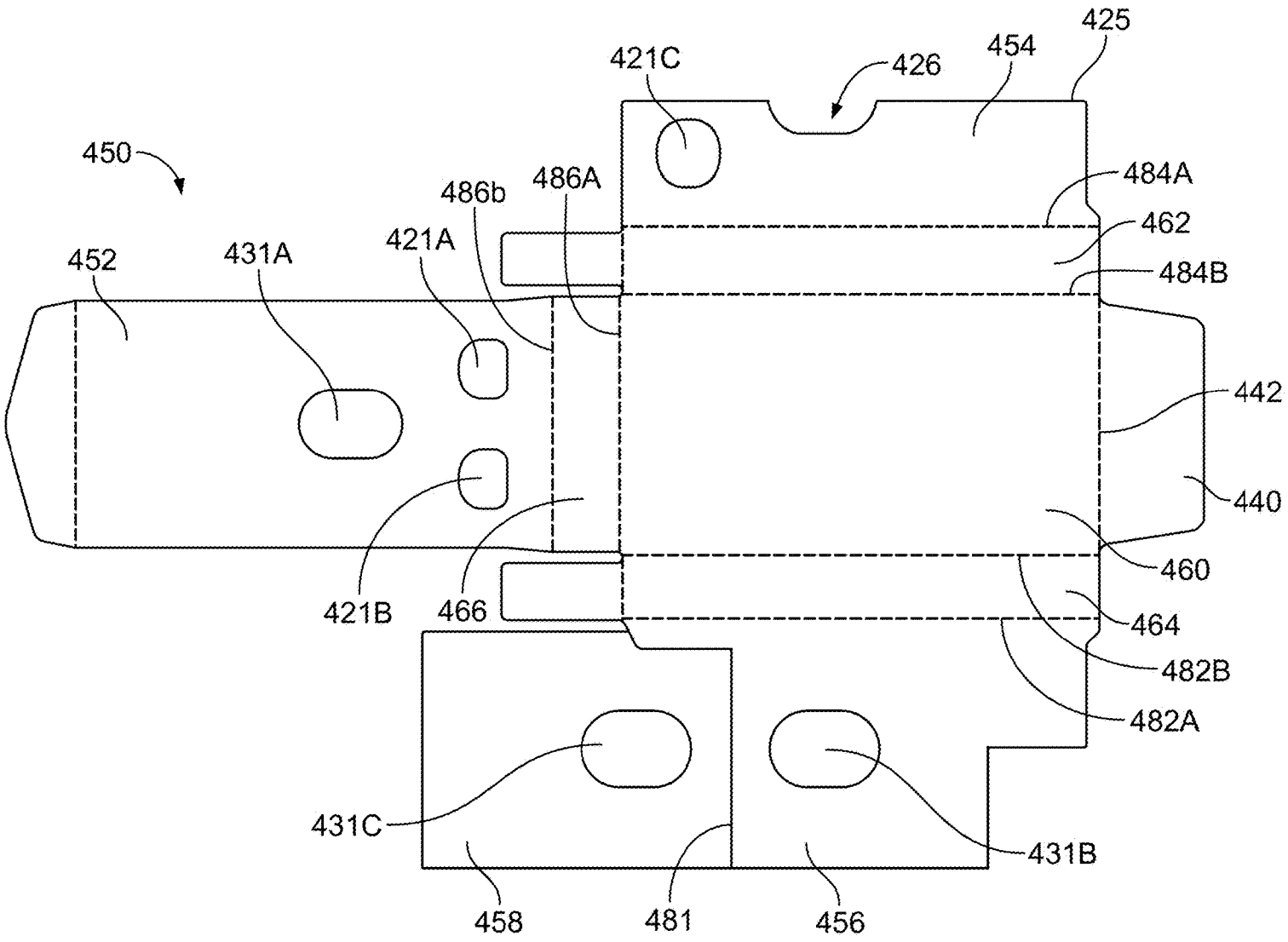
FIG. 9A illustrates a top view of an unconstructed housing component according to another embodiment of the invention.

FIG. 9A illustrates an unconstructed housing component 450. As shown in FIG. 9A, the unconstructed housing component 450 includes a plurality of panels: a first front face panel 452, a second front face panel 454, a third front face panel 456, a fourth front face panel 458, a rear face panel 460, a first side face panel 462, a second side face panel 464, and an end face panel 466.

The first front face panel 452 includes first tab openings 421A, 421B and a first guide opening 431A. The second front face panel 454 includes a second tab opening 421C. The second front face panel 454 also includes a removed portion 426 located along perimeter edge 425. The third front face panel 456 includes and a second guide opening 431B. The fourth front face panel 458 includes a third guide opening 431C. The rear face panel 460 includes a lock flap panel 440. The lock flap panel 440 is folded along panel border 442 toward the rear face panel 460. The folded lock flap panel 440 forms a receptacle 444 (see FIG. 12A).

Figure 9B:
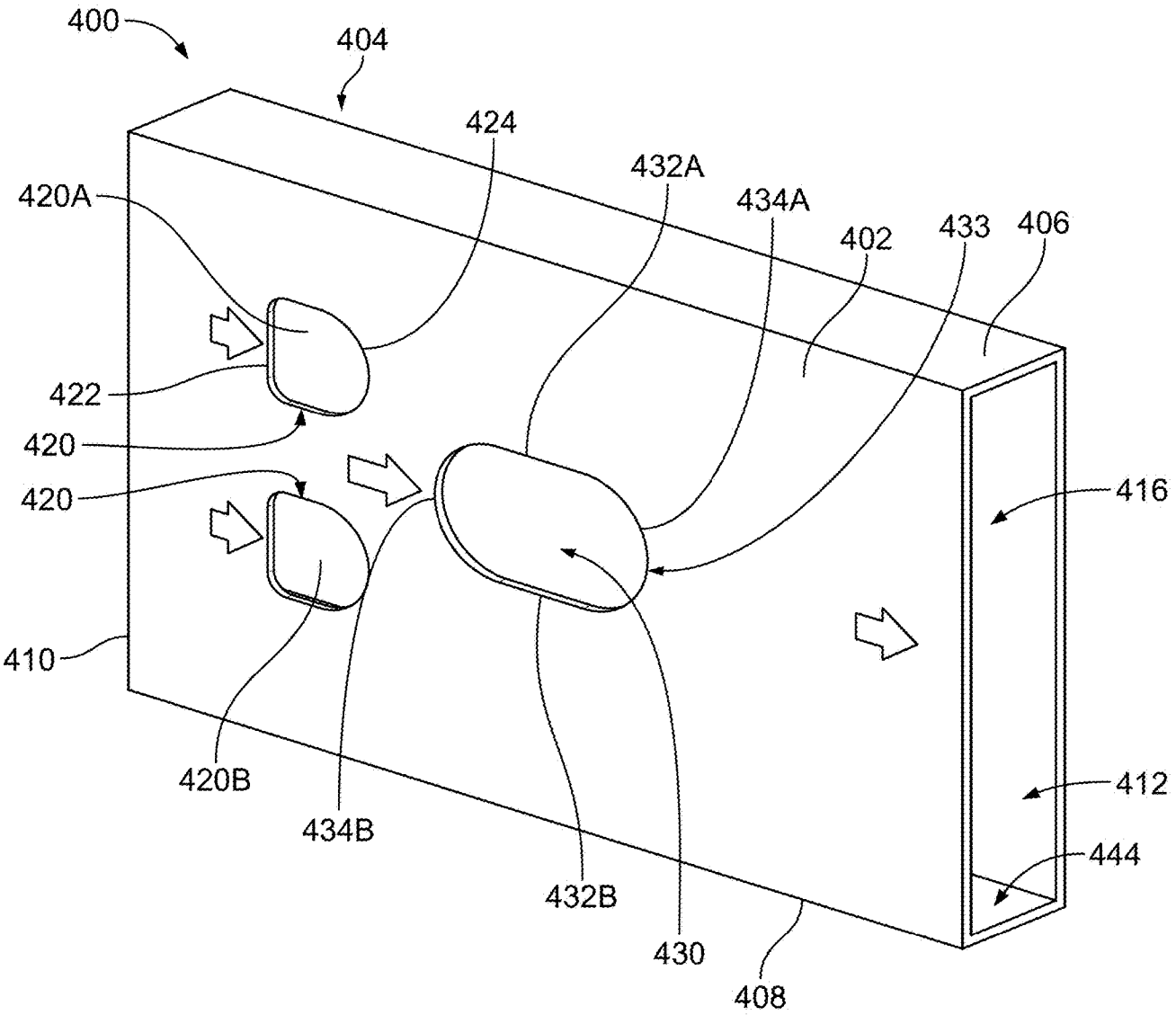
FIG. 9B illustrates a perspective view of a constructed housing component according to another embodiment of the invention.

The panels of the unconstructed housing component 450 are folded to form the constructed housing component 400 shown in FIG. 9B. As shown in FIG. 9A, fourth front face panel 458 is folded along fold line 481 to abut third front face panel 456 so that third guide opening 431C and second guide opening 431B are aligned. Second side face panel 464 is folded along fold lines 482A, 482B so that panels 456, 458 are positioned a distance from rear face panel 460. Second front face panel 454 is folded along fold lines 484A, 484B so that second front face panel 454 is positioned atop panels 456, 458. Once folded, second tab opening 421C and first tab opening 421A are aligned. Lastly, end face panel 466 is folded inwardly along fold lines 486A, 486B so that first front face panel 452 is positioned over panels 454, 456, 458 such that first guide opening 431A is aligned with third guide opening 431C and second guide opening 431B. Panels positioned over or layered on top of other panels provides strength and durability to the packaging. Once constructed with adhesion applied, the panels form an interior space 416 as shown in FIG. 9B.

Turning to FIG. 9B, housing component 400 includes a front face 402, a rear face 404, a first side face 406, a second side face 408, and an end face 410. Housing component 400 includes an open end 412 leading to an interior space 416 for receiving the insert component 500.

Tab aperture elements 420 are positioned on the front face 402 near the end face 410. Each tab aperture element 420A, 420B is defined by a straight edge border 422 and a curved edge border 424. Although the embodiment shown in FIG. 9B illustrates two tab aperture elements, the packaging may include only one tab aperture element as shown in FIG. 7.

Also located on the front face 402 in proximity to the tab aperture elements 420A, 420B is a guide aperture element 430. Guide aperture element 430 is defined by a continuous connected boundary 433. More specifically, as shown in FIG. 9B, the continuous connected boundary 433 is defined by straight edge boundaries 432A, 432B and curve edge boundaries 434A, 434B. A lock flap element 441 (FIGS. 12A-12D) formed by lock flap panel 440 (FIG. 9A) is located at the open end 412 by the folding of lock flap panel 440 along panel border 442 (FIG. 9A). As shown in FIGS. 12A-12D, the lock flap element 441 forms a receptacle 444. Within the interior space 416, a lip element 470 is located between the tab aperture elements 420 and guide aperture element 430. Lip element 470 is formed by fold line 481 (FIG. 9A).

Figure 10A:
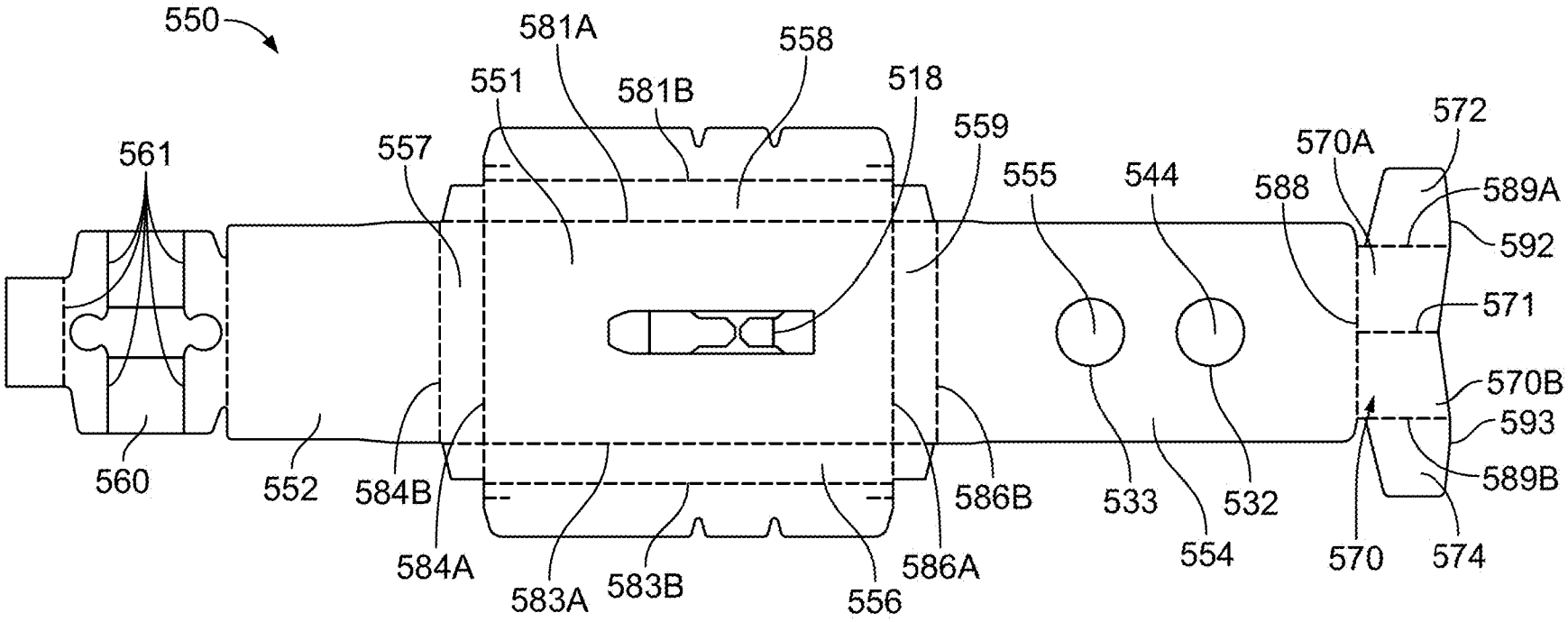
FIG. 10A illustrates a top view of an unconstructed insert component according to another embodiment of the invention.

FIG. 10A illustrates an unconstructed insert component 550. As shown in FIG. 10A, the unconstructed insert component 550 includes a plurality of insert panels: a front panel 551, a top surface panel 552, a bottom surface panel 554, a first side surface panel 556, a second side surface panel 558, a third side surface panel 557, a fourth side surface panel 559, an end surface panel 560, and a tab panel 570.

The bottom surface panel 554 includes a guide opening 544 and hole element 555. The guide opening 544 is defined by an edge border 532. The hole element 555 is defined by an edge boundary 533. Although both the guide opening 544 and hole element 555 are shown as circles in FIG. 10A, any shape is contemplated. Tab panel 570 includes a first tab panel 570A and a second tab panel 570B. The first tab panel 570A further includes a first tab portion 572 and the second tab panel 570B further includes a second tab portion 574. The first tab panel 570A and second tab panel 570B are separated by slit 571. Although the embodiment as shown illustrates the first tab panel 570A independent from the second tab panel 570B, it is contemplated that the first tab panel 570A and the second tab panel 570B are one in the same.

Figure 10B:
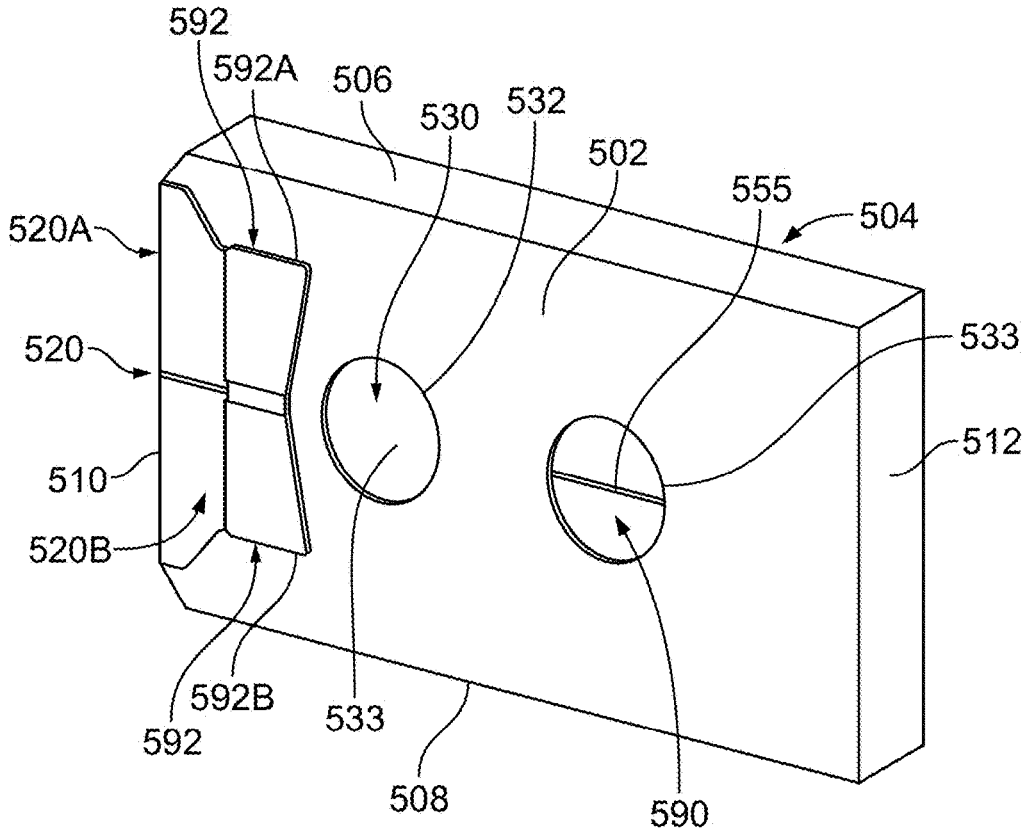
FIG. 10B illustrates a perspective view of a constructed insert component according to another embodiment of the invention.

The panels of the unconstructed insert component 550 are folded to form the constructed insert component 500 shown in FIG. 10B. As shown in FIG. 10A, top surface panel 552 and third side surface panel 557 are folded along fold lines 584A, 584B inward toward front panel 551. End surface panel 560 includes a plurality of fold lines 561 that are used to erect a support base 519 (see FIG. 10C) for cavity 518.

Bottom surface panel 554 and fourth side surface panel 559 are folded along fold lines 586A, 586B inward toward front panel 551. Once folded, top surface panel 552 abuts and covers guide opening 544.

Side surface panels 556,558 are folded along fold lines 583A, 583B and 581A, 581B, respectively. Side surface panels 556, 558 are folded inwardly toward front panel 551 so that top surface panel 552 is positioned a distance from bottom surface panel 554. Then, tab panel 570 is folded along fold line 588. Specifically, tab panel 570 is folded inwardly toward bottom surface panel 554 (FIG. 10B). It is shown that slit 571 separates the first tab panel 570A and the second tab panel 570B such that they are independent from one another. However, it is contemplated that the first tab panel 570A and the second tab panel 570B are one in the same.

First tab portion 572 and second tab portion 574 are folded along fold lines 589A, 589B, respectively, inward to the bottom surface panel 554 (FIG. 10B). In this embodiment of the invention, fold line 588 is perpendicular to 589A, 589B. Although the embodiment as shown illustrates a slit 571 such that the first tab panel 570A independent from the second tab panel 570B, it is contemplated that the first tab panel 570A and the second tab panel 570B may be one in the same.

Figure 10C:
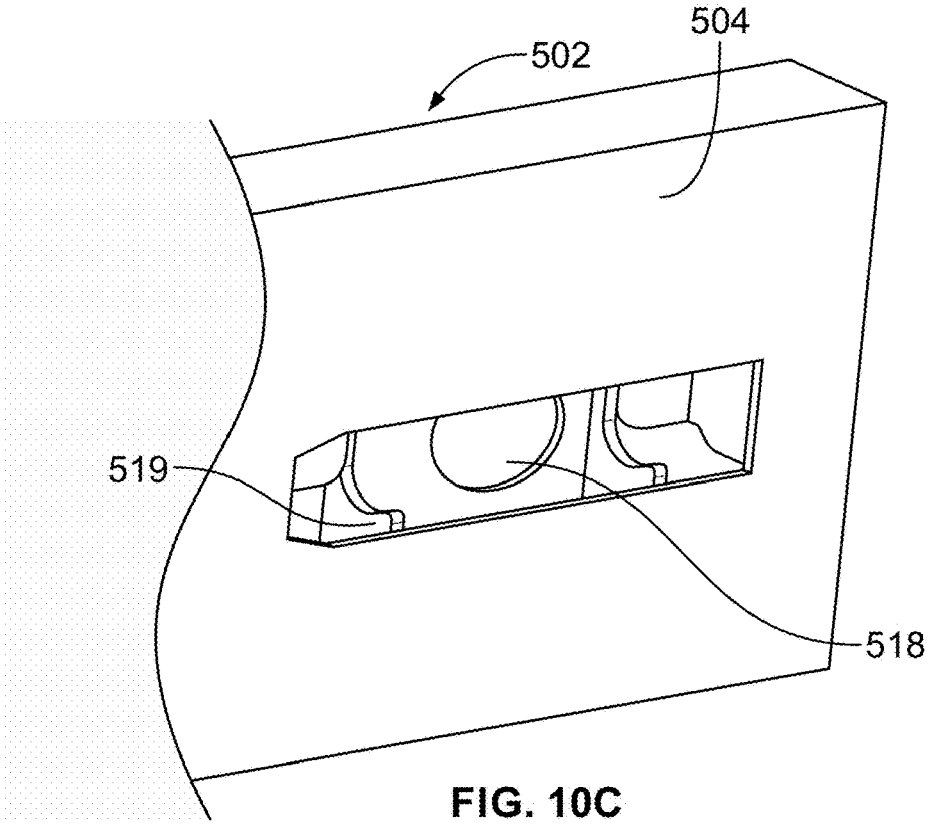
FIG. 10C illustrates another perspective view of a constructed insert component according to another embodiment of the invention.

As shown in FIG. 10B and FIG. 10C, insert component 500 includes a top surface 502, a bottom surface 504, a first side surface 506, a second side surface 508, an end surface 510, and a front surface 512. Insert component 500 includes a cavity 518 for receiving a product.

As shown in FIG. 10B, tab elements 520 are positioned on the top surface 502 near end surface 510 and are constructed from a tab panel 570 and a tab portion 572 (FIG. 10A). Once constructed, tab elements 520 include folds 592. Each fold 592A, 592B formed at fold lines 589A, 589B (FIG. 10A) are oriented perpendicular to end surface 510 and front surface 512, or parallel to first side surface 506 and second side surface 508. Each tab element 520A, 520B is a folded protrusion providing resiliency, i.e., tab elements 520 possesses a spring-like action. As shown, tab elements 520 are illustrated as a rectangular protrusion, however any shaped protrusion is contemplated. Also located on the top surface 502 in proximity to the tab elements 520 is a guide recess element 530. The guide recess element 530 is defined by opening 544 including edge border 532 and a base element 533. The base element 533 is formed from a portion of the top surface panel 552 (FIG. 10A) that is exposed through the opening 544. Although the guide recess element 530, particularly the edge border 532, is shown as circular shaped, any shape is contemplated. Insert component 500 also includes one or more indicator elements 590 located on the top surface 502. The indicator element 590 is defined by hole element 555, which is defined by edge boundary 533. The indicator element 590 assists with removing the insert component 500 from the housing component 400 so that the product may be retrieved from the cavity 518. Although the indicator element 590 is shown as a circle, any shape is contemplated.

Figure 11:
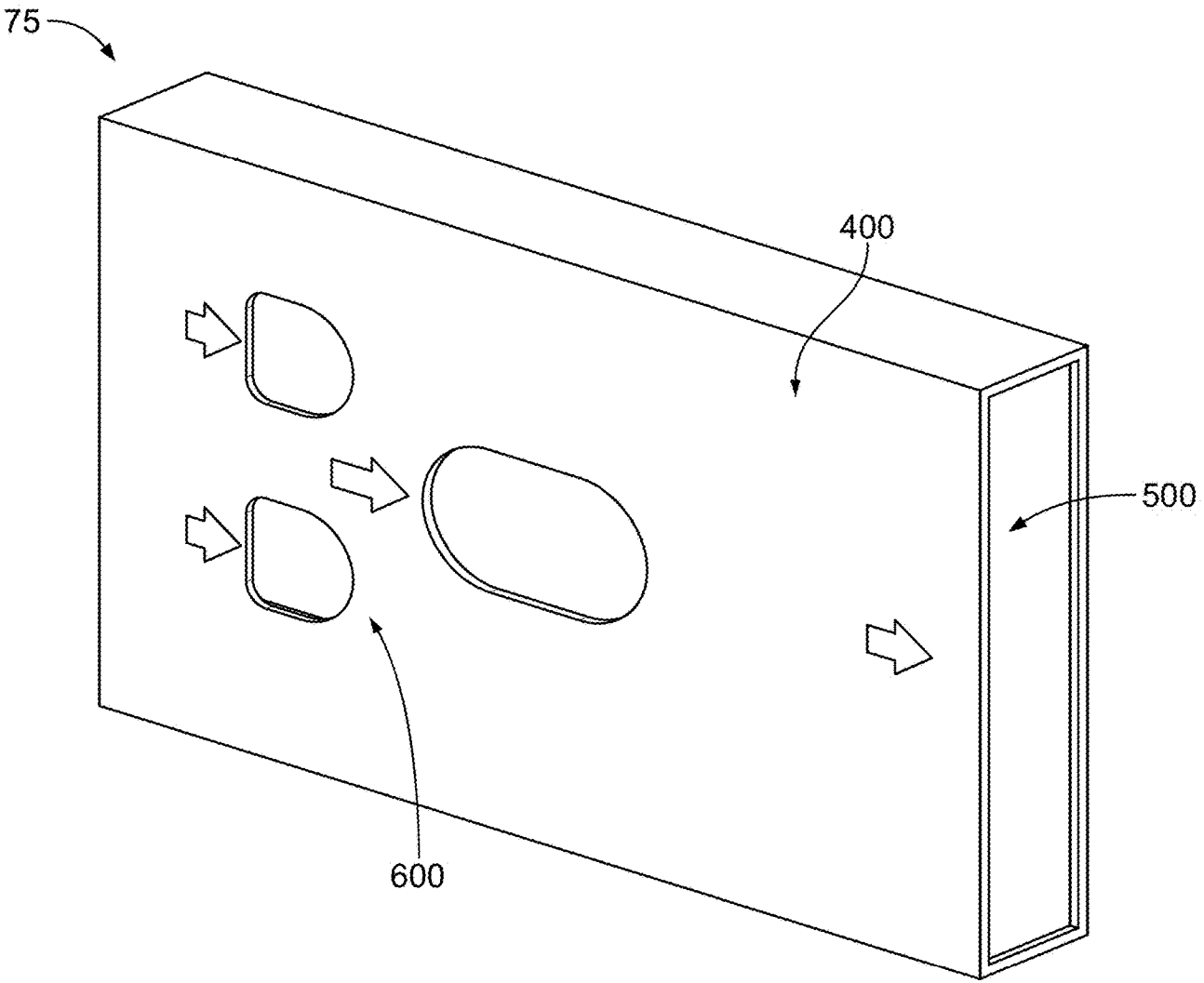
FIG. 11 illustrates a perspective view of the housing component and the insert component in a locked configuration according to another embodiment of the invention.
Figure 12A:
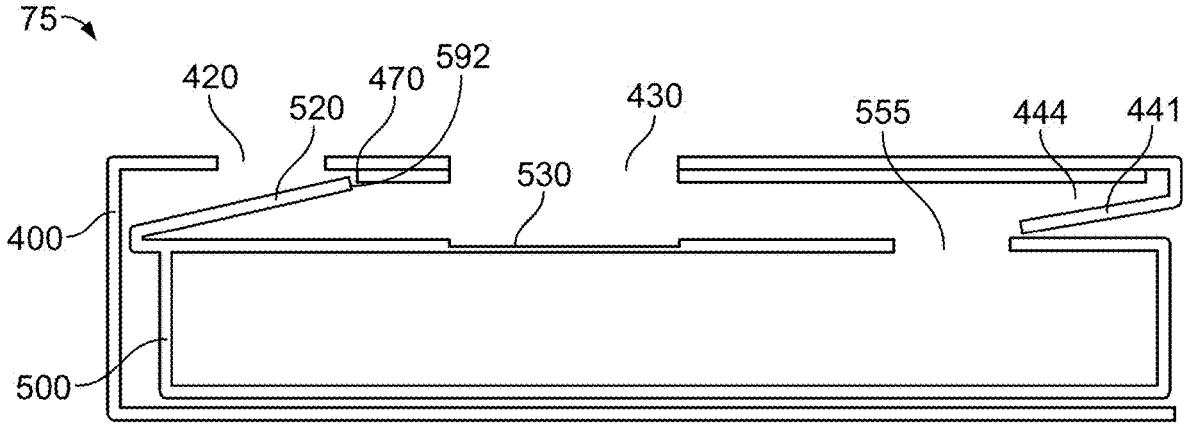
FIG. 12A illustrates a sectional side view of child resistant packaging in a locked configuration according to another embodiment of the invention.
Figure 12B:
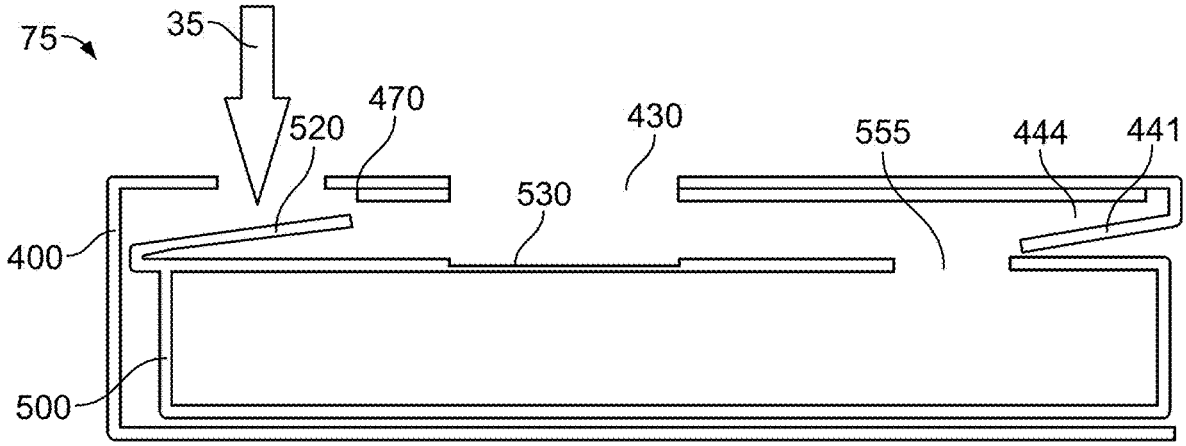
FIG. 12B illustrates a sectional side view of child resistant packaging in an unlocked configuration according to another embodiment of the invention.
Figure 12C:
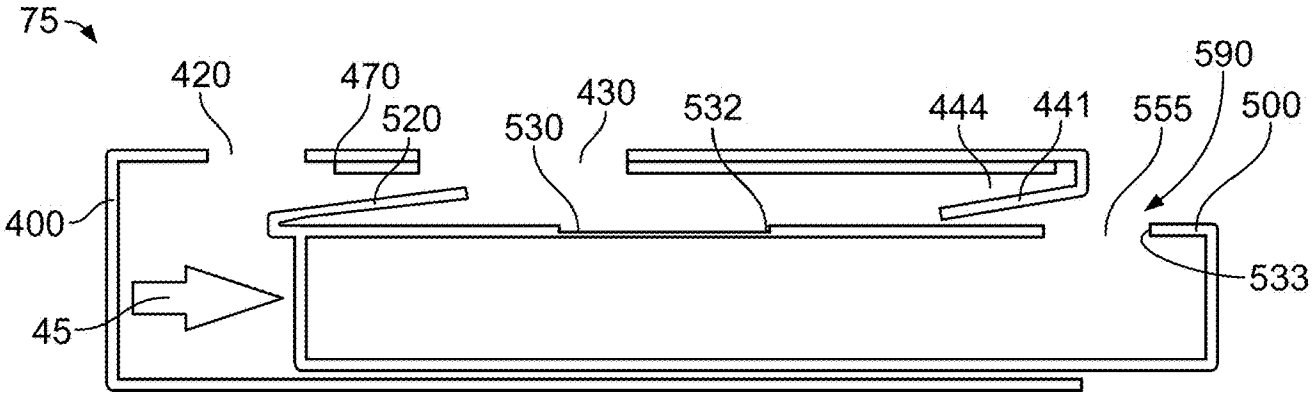
FIG. 12C illustrates a sectional side view of the child resistant packaging in an unlocked configuration according to another embodiment of the invention.

FIG. 11 illustrates a perspective view of the packaging 75 including housing component 400 and an insert component 500 with the locking mechanism 600 in a locked configuration according to the invention. As seen in the sectional side view of FIG. 12A, the tab elements 520 abut the lip element 470 obstructing movement of the insert component 500 from the interior space 416 (FIG. 9B) of the housing component 400. More specifically, tab portion edge 592 of first tab portion 572 abuts lip element 470 (FIG. 12A). Similarly, tab portion edge 593 of second tab portion 574 abuts lip element 470. Again, lip element 470 is formed by fold line 481 located between third front face panel 456 and a fourth front face panel 458 (FIG. 9A). As shown in FIG. 12B, vertical pressure 35 is applied to the tab elements 520—e.g., pressure is applied simultaneously to tab panel 570A and tab portion 572 and/or tab panel 570B and tab portion 574—such that the tab elements 520 are released from the lip element 470 by way of the tab aperture elements 420 in order to un-obstruct movement of the insert component 500 from the housing component 400. To remove a portion of the insert component 500 from the housing component 400, lateral pressure 45 is applied to the edge border 532 of the guide recess element 530 as shown in FIG. 12C. With a portion of the insert component 500 removed from the housing component 400, a user may grasp this portion—such as by top surface 502 and bottom surface 504—near the front surface 512 to further remove the insert component 500 from the housing component 400. Further, a user may use indicator element 590 to assist with removing the insert component 500 from the housing component 400 by grasping at edge boundary 533 of hole element 555.

Figure 12D:
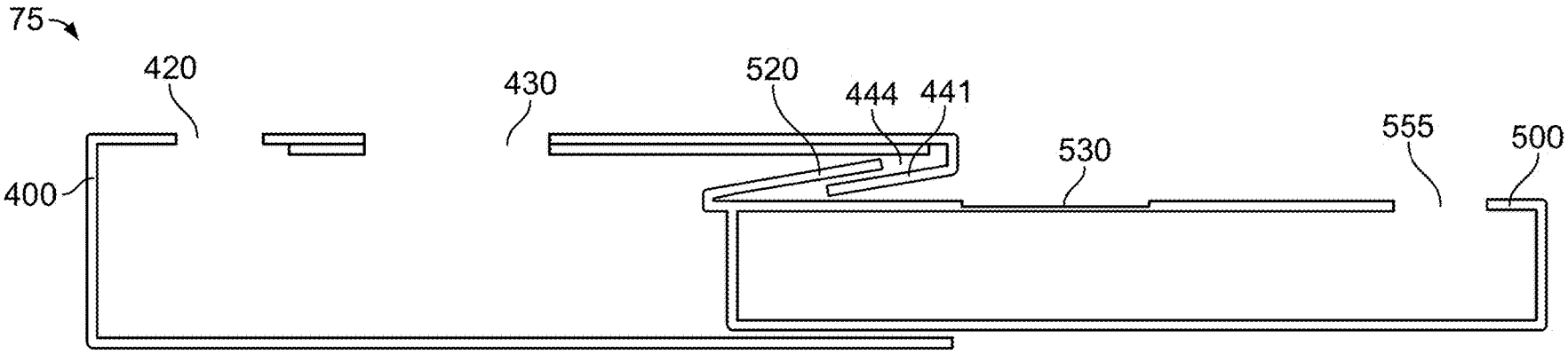
FIG. 12D illustrates a sectional side view of the child resistant packaging in an unlocked configuration according to another embodiment of the invention.

As shown in FIG. 12D, lock flap element 441 forms a receptacle 444 for receiving the tab elements 520. The receptacle 444 receives tab elements 520 to prevent the insert component 500 from separating from the housing component 400 while the insert component 500 is removed from the housing component 400. FIG. 8 illustrates a perspective view of the packaging 75 in an unlocked configuration according to the invention.

Figure 13:
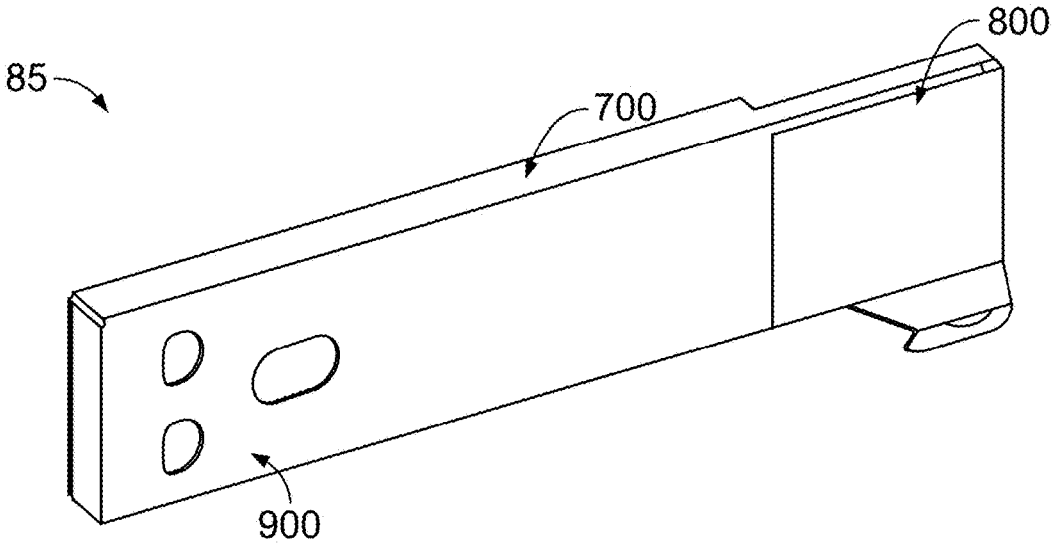
FIG. 13 illustrates a perspective view of the child resistant packaging according to an alternate embodiment of the invention.

A child resistant product packaging according to an alternate embodiment is shown in FIG. 13. The packaging 85 includes a housing component 700 and an insert component 800. Both the housing component 700 and insert component 800 include interacting elements that form a locking mechanism 900. The locking mechanism 900 enables a locked configuration and an unlocked configuration between the housing component 700 and the insert component 800. When the locking mechanism 900 is activated, the insert component 800 cannot be moved with respect to the housing component 700. When the locking mechanism 900 is deactivated, through a series of movements or steps in coordination or combination, the insert component 800 slideably interacts with the housing component 700 for access to a product stored within the insert component 800.

Figure 14B:
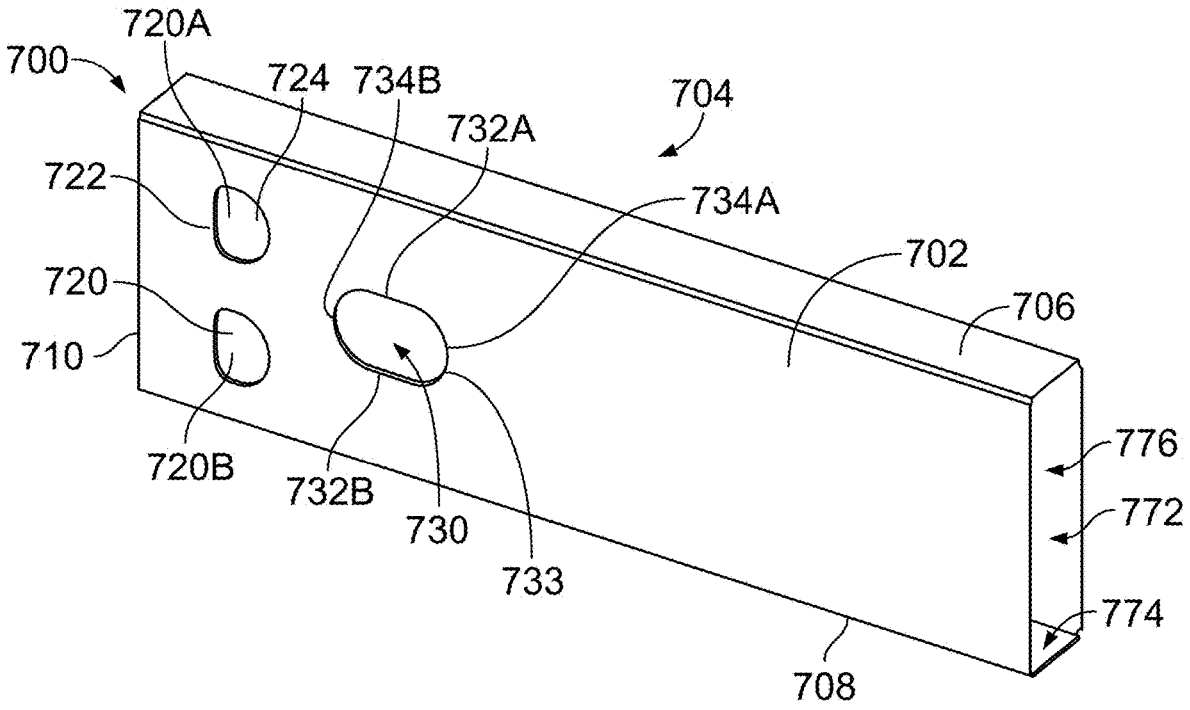
FIG. 14B illustrates a perspective view of a constructed housing component according to an alternate embodiment of the invention.
Figure 14A:
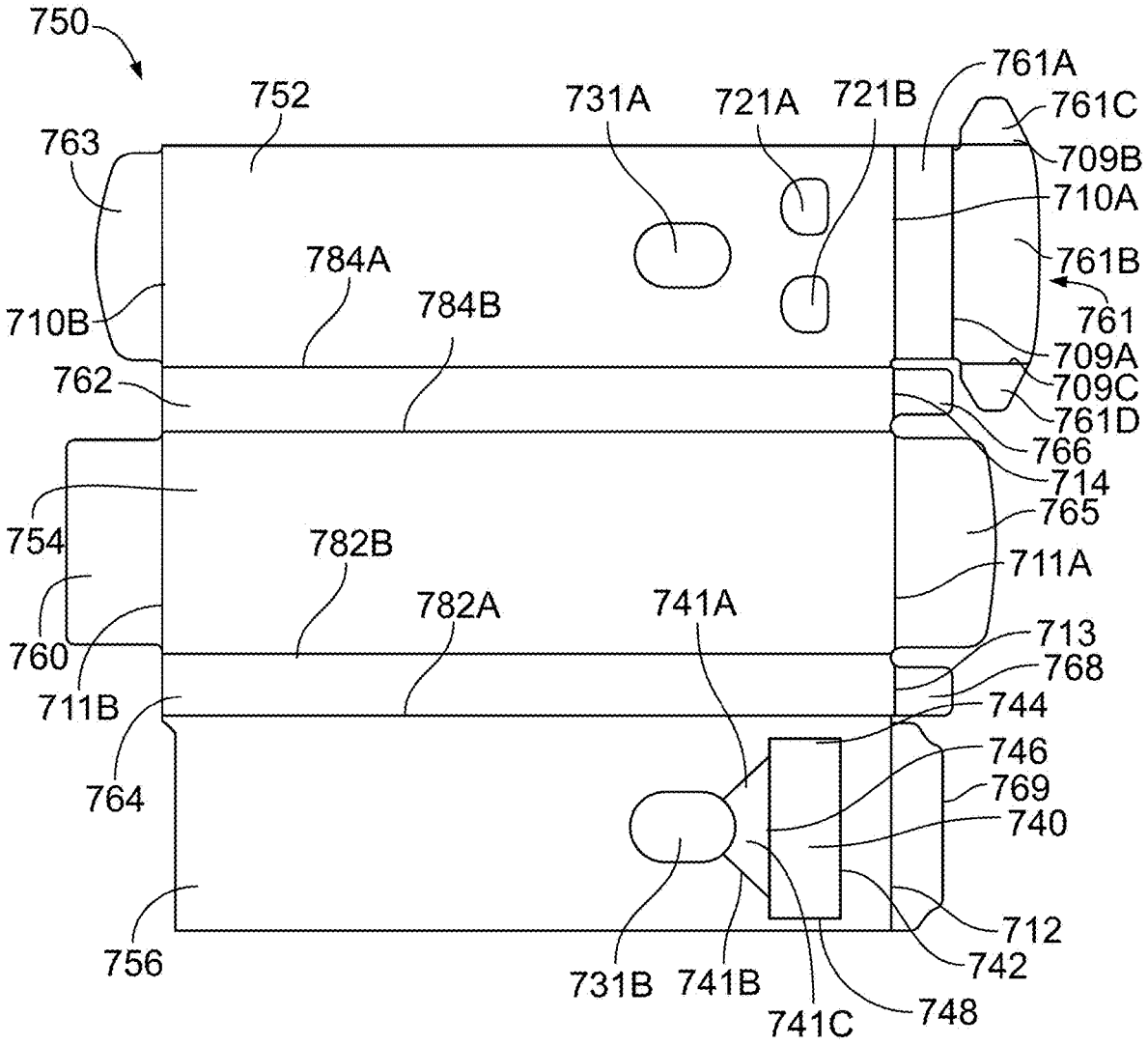
FIG. 14A illustrates a top view of an unconstructed housing component according to an alternate embodiment of the invention.

FIG. 14A illustrates an unconstructed housing component 750. As shown in FIG. 14A, the unconstructed housing component 750 includes a plurality of panels: a first front face panel 752, a second front face panel 754, a third front face panel 756, a first side face panel 762, a second side face panel 764. The first front face panel 752 includes a first end face panel 761 and a second end face panel 763. The first front face panel 752 and the first end face panel 761 share fold line 710A and the first front face panel 752 and the second end face panel 763 share fold line 710B.

First end face panel 761 further includes panels 761A and 761B separated by fold line 709A. Side flaps 761C, 761D are separated from panel 761B by fold lines 709B, 709C, respectively.

The second front face panel 754 includes a third end face panel 765 and a fourth end face panel 767. The second front face panel 754 and the third end face panel 765 share fold line 711A and the second front face panel 754 and the fourth end face panel 767 share fold line 711B.

The third front face panel 756 includes a fifth end face panel 769, which share fold line 712. Each side face panel 762, 764 include flaps 766, 768 respectively. Flap 766 shares fold line 714 with side face panel 762 and flap 768 shares fold line 713 with side face panel The first front face panel 752 includes a first tab opening 721A, a second tab opening 721B and a first guide opening 731A. The third front face panel 756 includes a second guide opening 731B and an aperture element 740. Aperture element 740 is defined by edges 742, 744, 746, 748. A first score line 741A and a second score line 741B are formed on the third front face panel 756 and extend between the second guide opening 731B and aperture element 740. The score lines 741A, 741B define a portion 741C that is positioned between the guide opening 731B and aperture element 740. The portion 741C assists the function of the locking mechanism 900. As shown in FIG. 14A, the score lines are non-parallel to one another, specifically formed at a 90 degree angle to one another; however, any quantity and any angle is contemplated.

The panels of the unconstructed housing component 750 are folded to form the constructed housing component 700 shown in FIG. 14B. As shown in FIG. 14A, a first front face panel 752 and third front face panel 756 are folded inwardly along fold lines 784A and 782A. First side face panel 762 and second side face panel 764 are folded parallel to each other and the first guide opening 731A is and aligned with the second guide opening 731B. The housing component 750 is constructed with the third front face panel 756 located under 752 the first front face panel 752, i.e., the third front face panel 756 forming a surface of interior space 716. Hence, aperture element 740 is located within the interior space 716.

One end of the housing component 700 is completely enclosed by folded panels 761, 765, 766, 768, 769. In this embodiment, the housing may be constructed without glue or any other adhesive.

Turning to FIG. 14B, housing component 700 includes a front face 702, a rear face 704, a first side face 706, a second side face 708, and an end face 710. Housing component 700 includes an open end 772 leading to an interior space 716 for receiving the insert component 800.

Tab aperture elements 720 are positioned on the front face 702 near the end face 710. Each tab aperture element 720A, 720B is defined by a straight edge border 722 and a curved edge border 724. Although the embodiment shown in FIG. 14B illustrates two tab aperture elements, the packaging may include only one tab aperture element as shown in FIG. 7.

Also located on the front face 702 in proximity to the tab aperture elements 720A, 720B is a guide aperture element 730. Guide aperture element 730 is defined by a continuous connected boundary 733. More specifically, as shown in FIG. 14B, the continuous connected boundary 733 is defined by straight edge boundaries 732A, 732B and curve edge boundaries 734A, 734B.

A lock flap element 761 (FIGS. 17A-17D) formed by lock flap panel 760 (FIG. 14A) is located at the open end 772 by the folding of lock flap panel 760 along panel border 711B (FIG. 14A). As shown in FIGS. 17A-17D, the lock flap element 761 forms a receptacle 744. Within the interior space 716, a lip element 770 is located between the tab aperture elements 720 and guide aperture element 730. Lip element 770 is formed by edges 742, 746 of aperture element 740 and includes an inclined surface of portion 741C formed by score lines 741A, 741B.

Figure 15A:
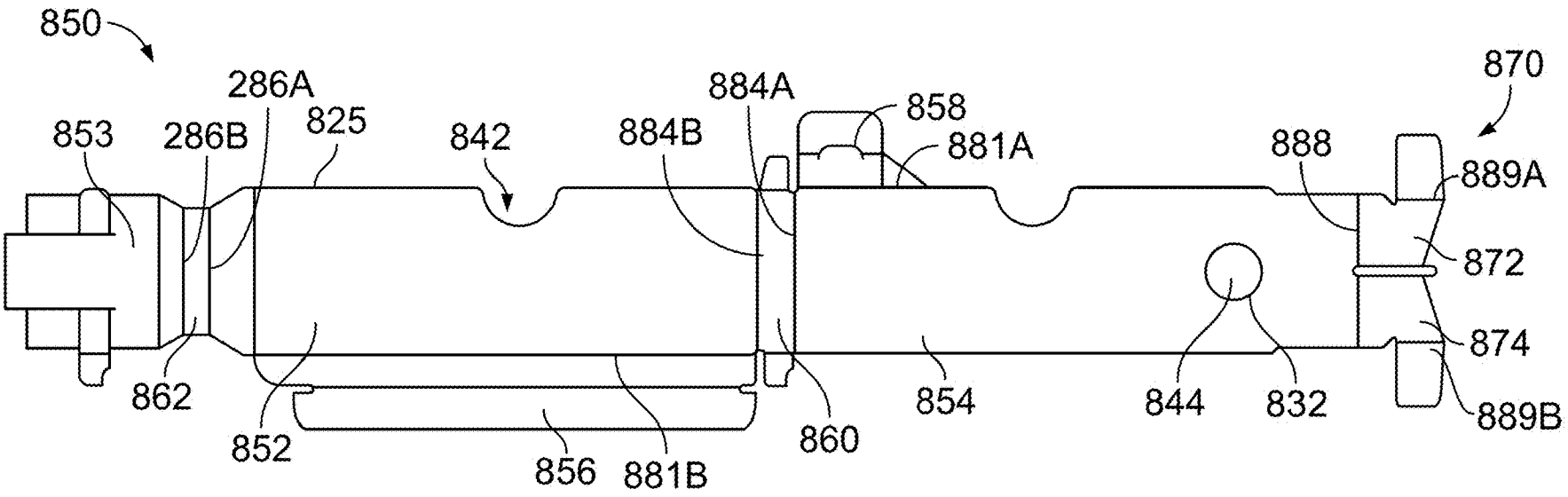
FIG. 15A illustrates a top view of an unconstructed insert component according to an alternate embodiment of the invention.

FIG. 15A illustrates an unconstructed insert component 850. As shown in FIG. 15A, the unconstructed insert component 850 includes a plurality of insert panels: a top surface panel 852, a top end panel 853, a bottom surface face panel 854, a first side surface panel 856, a second side surface panel 858, an end surface panel 860, a front surface panel 262, and a tab panel 870.

The top surface panel 852 includes removed portion 842 along perimeter edge 825. The bottom surface face panel 854 includes a guide opening 844. The guide opening 844 is defined by an edge border 832. Although the guide opening 844 is shown as a circle in FIG. 15A, any shape is contemplated.

Tab panel 870 includes a first tab portion 872 and a second tab portion 874. Although the embodiment as shown illustrates the first tab portion 872 independent from the second tab portion 874, it is contemplated that the first tab portion 872 and the second tab portion 874 may be unitary, i.e., integrated as one.

Figure 15B:
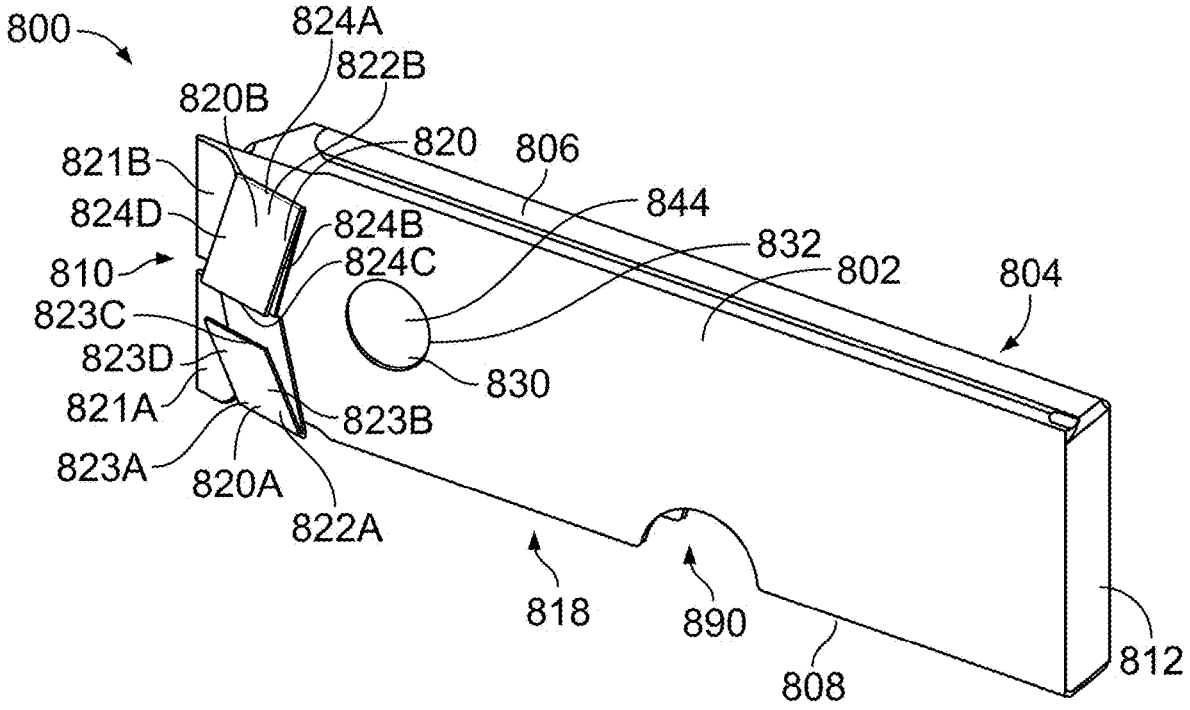
FIG. 15B illustrates a perspective view of a constructed insert component according to an alternate embodiment of the invention.

The panels of the unconstructed insert component 850 are folded to form the constructed insert component 800 shown in FIG. 15B. As shown in FIG. 15A, end surface panel 860 is folded along fold lines 884A, 884B so that top surface panel 852 is positioned a distance from bottom surface panel 854.

Once folded, top end panel 853 abuts and covers guide opening 844. Side surface panels 856 and 858 are folded along fold lines 881B and 881A, respectively. Front surface panel 862 is folded along fold lines 286A, 286B. Tab panel 870 is folded inwardly to bottom surface panel 854 along fold line 888. Furthermore, first tab portion 872 and second tab portion 874 are folded inward toward each other along fold lines 889A, 889B, respectively. In this embodiment of the invention, fold line 888 is perpendicular to each of the fold lines 889A, 889B. Once constructed, the panels form a cavity 818 as shown in FIG. 15B for storing product. In this embodiment, the insert component 800 may be constructed without glue or any other adhesive.

As shown in FIG. 15B, insert component 800 includes a top surface 802, a bottom surface 804, a first side surface 806, a second side surface 808, an end surface 810, and a front surface 812. Insert component 800 includes a cavity 818 for receiving a product.

As shown in FIG. 15B, tab elements 820 are positioned on the top surface 802 near end surface 810 and are constructed from a tab panel 870 and a tab portions 872, 874 (FIG. 15A). Tab portions 872, 874 are folded along fold lines 889A, 889B, respectively, to form tab elements 820A, 820B. First tab element 820A includes a first base flap 821A and a first auxiliary flap 822A. Second tab element 820B includes a second base flap 821B and a second auxiliary flap 822B.

Base flaps 821A, 821B are folded inward along fold line 888 toward the top surface 802. It should be noted that a portion of base flaps 821A, 821B extend beyond end surface 810 (see, e.g., FIG. 17A) Base flap 821A is further folded along fold line 889A to form auxiliary flap 822A. Fold line 889A forms outside edge 823A of flap 822A. Auxiliary flap 822A further includes an inside edge 823C, a first side edge 823A, and a second side edge 823D. Similarly, base flap 821B is further folded along fold line 889B to form auxiliary flap 822B. Fold line 889A forms outside edge 824A of flap 822B. Auxiliary flap 822B further includes an inside edge 824C, a first side edge 824A, and a second side edge 824D.

Edges 823A, 824A are oriented perpendicular to end surface 810 and front surface 812, or parallel to first side surface 806 and second side surface 808. Each tab element 820A, 820B is a folded protrusion providing resiliency, i.e., tab elements 820 possesses a spring-like action. As shown, tab elements 820 are illustrated as a rectangular protrusion, however any shaped protrusion is contemplated. Also located on the top surface 802 in proximity to the tab elements 820 is a guide recess element 830. The guide recess element 830 is defined by opening 844 including edge border 832 and a base element 833. The base element 833 is formed from a portion of the top end panel 853 (FIG. 15A) that is exposed through the opening 844. Although the guide recess element 830, particularly the edge border 832, is shown as circular shaped, any shape is contemplated. Insert component 800 also includes indicator elements 890 located on each of the top surface 802 and the bottom surface 804. The indicator elements 890 are semi-circular shaped and assist with removing the product from the cavity 818.

Figure 16:
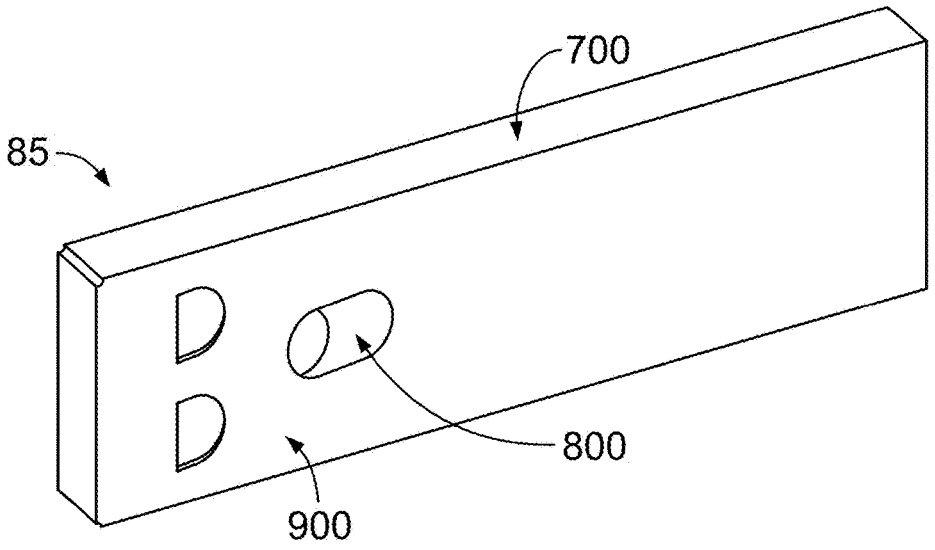
FIG. 16 illustrates a perspective view of the housing component and the insert component in a locked configuration according to an alternate embodiment of the invention.

FIG. 16 illustrates a perspective view of the packaging 85 including housing component 700 and an insert component 800 with the locking mechanism 900 in a locked configuration according to the invention.

Figure 17A:
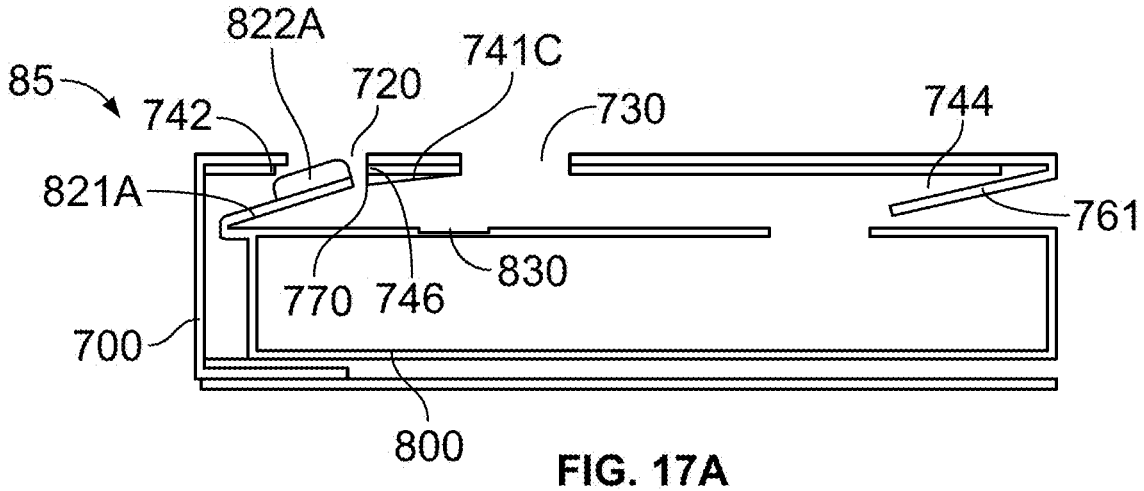
FIG. 17A illustrates a sectional side view of child resistant packaging in a locked configuration according to an alternate embodiment of the invention.

As seen in the sectional side view of FIG. 17A, the tab elements 820 abut the lip element 870 obstructing movement of the insert component 800 from the interior space 716 (FIG. 14B) of the housing component 700.

More specifically, the side view of FIG. 17A shows the first tab element 820A in a locked position in which side edges 823B, 823D abut edges 742, 746 of aperture element 740. Similarly, in a locked position the side edges 824B, 824D of second tab element 820B abut edges 742, 746 of aperture element 740. In further detail, lip element 770 includes an inclined surface of portion 741C formed by score lines 741A, 741B. This inclined surface assists with securing the tab elements within aperture element 740 as well as assist the tab elements 820A, 820B from transitioning from the lock position to unlocked position.

Figure 17B:
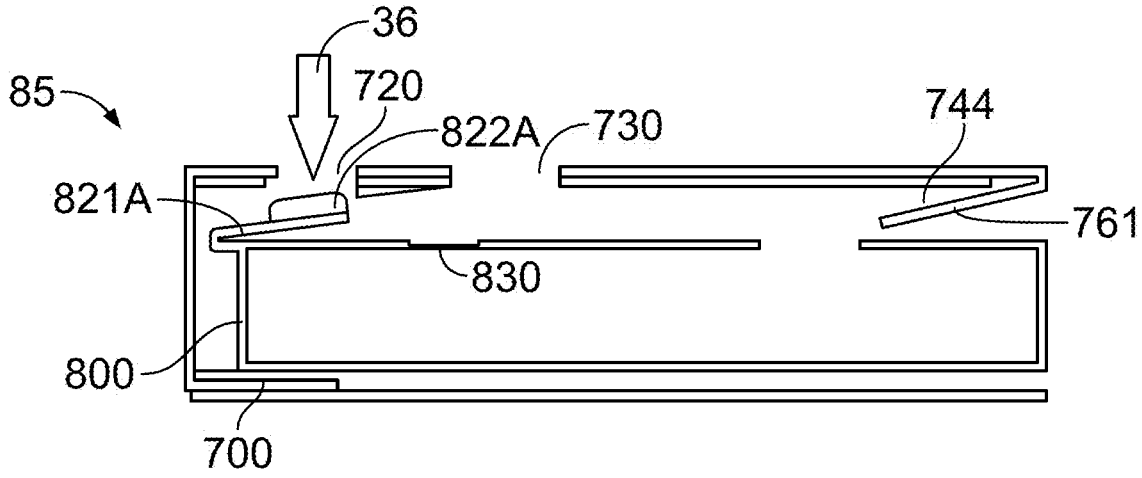
FIG. 17B illustrates a sectional side view of child resistant packaging in an unlocked configuration according to an alternate embodiment of the invention.
Figure 17C:
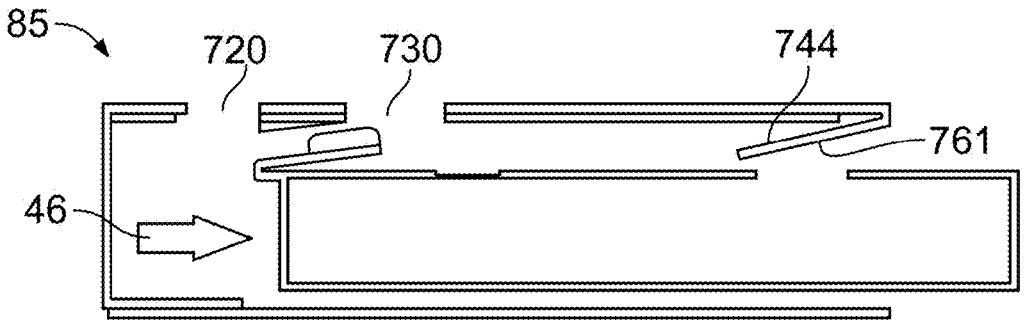
FIG. 17C illustrates a sectional side view of the child resistant packaging in an unlocked configuration according to an alternate embodiment of the invention.

As shown in FIG. 17B, vertical pressure 36 is applied to the tab elements 820A, 820B—e.g., pressure is applied simultaneously to base flap 821A and a first auxiliary flap 822A of first tab element 820A—such that the tab elements 820 are released from the aperture element 740 to unobstruct movement of the insert component 800 from the housing component 700. To remove a portion of the insert component 800 from the housing component 700, lateral pressure 46 is applied to the edge border 832 of the guide recess element 830 as shown in FIG. 17C. With a portion of the insert component 800 removed from the housing component 700, a user may grasp this portion—such as by top surface 802 and bottom surface 804—near the front surface 812 to further remove the insert component 800 from the housing component 700. Further, a user may use indicator element 890 to assist with removing the insert component 800 from the housing component 700.

Figure 17D:
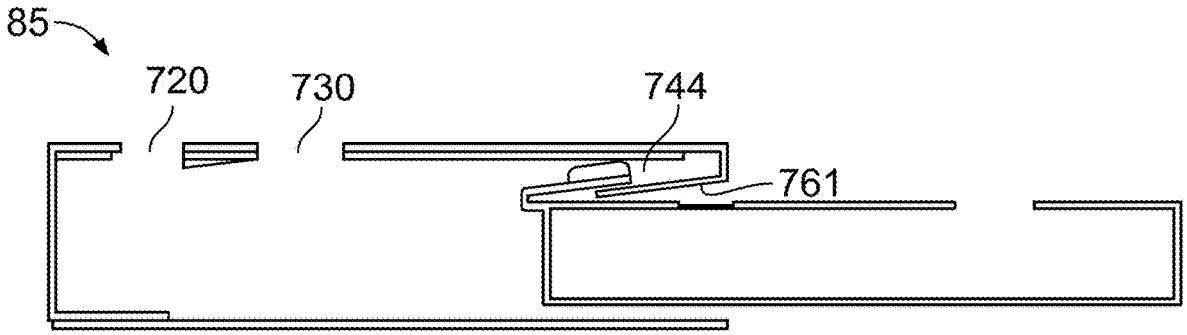
FIG. 17D illustrates a sectional side view of the child resistant packaging in an unlocked configuration according to an alternate embodiment of the invention.

As shown in FIG. 17D, lock flap element 761 forms a receptacle 744 for receiving the tab elements 820. The receptacle 744 receives tab elements 820 to prevent the insert component 800 from separating from the housing component 700 while the insert component 800 is removed from the housing component 700.

While this disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

The invention claimed is:

1. A child resistant packaging comprising:

a housing component comprising housing panels folded to form an interior space, the housing component including one or more tab aperture elements, a guide aperture element, and a lip element, the guide aperture element defined by a continuous connected boundary;

an insert component comprising insert panels folded to form a cavity configured to store a product, the insert component including a body and one or more tab elements, wherein each of the one or more tab elements are constructed from a tab panel and a tab portion, the tab panel including a first fold line shared with the body, the tab panel including a second fold line shared with the tab portion, wherein the second fold line and the first fold line are perpendicular, the tab portion comprising a tab portion edge, the insert component configured to slideably interact with the interior space of the housing component between a locked configuration and an unlocked configuration, in the locked configuration, the one or more tab elements abut a panel edge of the lip element of the housing component, the locked configuration obstructing movement of the insert component from the interior space of the housing component, and a portion of both the base element and the edge border of the guide recess element accessible through the guide aperture element, in the unlocked configuration, the one or more tab elements released from the panel edge of the lip element of the housing component via the one or more tab aperture elements, the unlocked configuration un-obstructing movement of the insert component from the interior space of the housing component.

2. The child resistant packaging according to claim 1, wherein the tab panel is folded along a first fold line inward to a bottom surface panel of an unconstructed insert panel, and the tab portion is folded along the fold line outward from the bottom surface panel.

3. The child resistant packaging according to claim 1, wherein the tab panel is folded along a first fold line inward to a bottom surface panel of an unconstructed insert panel, and the tab portion is folded along the fold line inward to the bottom surface panel.

4. The child resistant packaging according to claim 1, wherein the tab portion comprises a first tab portion independent from a second tab portion.

5. The child resistant packaging according to claim 1, wherein the fold formed at the fold line is oriented parallel to an end surface and a front surface of the insert component or perpendicular to a first side surface and a second side surface of the insert component.

6. The child resistant packaging according to claim 1, wherein the fold formed at the fold line is oriented perpendicular to an end surface and a front surface of the insert component or parallel to a first side surface and a second side surface of the insert component.

7. The child resistant packaging according to claim 2, wherein the first fold line is oriented parallel to the second fold line.

8. The child resistant packaging according to claim 3, wherein the first fold line is oriented perpendicular to the second fold line.

9. The child resistant packaging according to claim 1, wherein the tab portion edge of first tab portion abuts the lip element in the locked configuration.

10. The child resistant packaging according to claim 1, wherein a fold formed at a fold line of the tab portion abuts the lip element in the locked configuration.

11. The child resistant packaging according to claim 1 further comprising a guide recess element, wherein the guide recess element is constructed from an insert component comprising a first insert panel and a second insert panel, wherein the first insert panel includes an opening defined by an edge border, the first insert panel and the second insert panel folded to cover one another such that a base element comprising a portion of the second insert panel is exposed through the opening of the first insert panel.

12. The child resistant packaging according to claim 1 wherein the housing component further comprises a lock flap element, the lock flap element configured to contain a portion of the one or more tab elements preventing the insert component from being completely removed from the housing component.

13. The child resistant packaging according to claim 1, wherein the insert component further comprises a hole element.

14. The child resistant packaging according to claim 13, wherein the hole element is circular shaped.

15. The child resistant packaging according to claim 1, wherein the housing component is made from a paper-based material.

16. The child resistant packaging according to claim 15, wherein the paper-based material is laminated.

17. The child resistant packaging according to claim 1, wherein the insert component is made from a laminated paper-based material.

18. A method for operating packaging, the method comprising the steps of:

placing the packaging on a surface, wherein the packaging includes a housing component with an interior space containing an insert component;

applying a vertical pressure to a tab panel and a tab portion of a tab element positioned on the insert component to release the tab element from a lip element, wherein the tab panel and the tab portion of are simultaneously accessible through one or more first aperture elements of the housing component;

exposing outside the housing component a portion of the insert component by applying a lateral pressure to a guide recess element positioned on the insert component, wherein the guide recess element comprises an opening defined by an edge border and a portion of the insert component exposed through the opening, wherein a portion of the edge border of the guide recess element is accessible through a guide aperture element of the housing component, the guide aperture element defined by a continuous connected boundary;

releasing the pressure to the tab panel and the tab portion; and using a hole element on the exposed portion of the insert component to remove the remaining portion of the insert component from the interior space of the housing component.

19. The method for operating packaging according to claim 18 further comprising the step of:

pushing the exposed portion of the insert component to move the insert component into the interior space of the housing component.

20. A child resistant packaging comprising:

a housing component comprising housing panels folded to form an interior space, the housing component including one or more tab aperture elements, a guide aperture element, and an aperture element, the guide aperture element defined by a continuous connected boundary;

an insert component comprising insert panels folded to form a cavity configured to store a product, the insert component including a body and one or more tab elements, wherein each of the one or more tab elements are constructed from a tab panel and a tab portion, the tab panel including a first fold line shared with the body, the tab panel including a second fold line shared with the tab portion, wherein the second fold line and the first fold line are parallel, the tab portion comprising a tab portion edge, the insert component configured to slideably interact with the interior space of the housing component between a locked configuration and an unlocked configuration, in the locked configuration, the one or more tab elements abut two or more edges of the aperture element of the housing component, the locked configuration obstructing movement of the insert component from the interior space of the housing component, and a portion of both the base element and the edge border of the guide recess element accessible through the guide aperture element, in the unlocked configuration, the one or more tab elements released from the two or more edges of the aperture element of the housing component via the one or more tab aperture elements, the unlocked configuration un-obstructing movement of the insert component from the interior space of the housing component.

* * * * *